US008424996B2

(12) United States Patent
Iriguchi

(10) Patent No.: US 8,424,996 B2
(45) **Date of Patent: *Apr. 23, 2013**

(54) JETTING TIMING DETERMINING METHOD, LIQUID-DROPLET JETTING METHOD AND INK-JET PRINTER

(75) Inventor: Akira Iriguchi, Ichinomiya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 130 days.

This patent is subject to a terminal disclaimer.

(21) Appl. No.: 12/648,729

(22) Filed: Dec. 29, 2009

(65) Prior Publication Data

US 2010/0103215 A1 Apr. 29, 2010

Related U.S. Application Data

(62) Division of application No. 11/604,991, filed on Nov. 28, 2006, now Pat. No. 7,661,788.

(30) Foreign Application Priority Data

Nov. 28, 2005 (JP) ..... 2005-341345

(51) Int. Cl.
*B41J 29/393* (2006.01)
*B41J 29/38* (2006.01)

(52) U.S. Cl.
USPC ..... 347/19; 347/12

(58) Field of Classification Search ..... 347/43
See application file for complete search history.

(56) References Cited

U.S. PATENT DOCUMENTS

| | | | | |
|---|---|---|---|---|
| 5,796,416 | A | 8/1998 | Silverbrook | |
| 6,719,390 | B1 | 4/2004 | Howkins et al. | |
| 2003/0063152 | A1* | 4/2003 | Edamura et al. | 347/36 |
| 2004/0201638 | A1 | 10/2004 | Imai | |
| 2005/0007416 | A1* | 1/2005 | Takekoshi et al. | 347/41 |
| 2005/0018012 | A1* | 1/2005 | Iwasaki et al. | 347/43 |
| 2005/0052505 | A1* | 3/2005 | Ito | 347/71 |
| 2005/0062805 | A1* | 3/2005 | Ito | 347/71 |
| 2005/0146547 | A1 | 7/2005 | Yeh et al. | |
| 2005/0190221 | A1 | 9/2005 | Iriguchi | |
| 2006/0238782 | A1* | 10/2006 | Kim | 358/1.9 |
| 2007/0024677 | A1* | 2/2007 | Katayama | 347/71 |
| 2007/0200889 | A1 | 8/2007 | Iriguchi | |

FOREIGN PATENT DOCUMENTS

| | | |
|---|---|---|
| JP | 2000-263770 | 9/2000 |
| JP | 2004-306485 | 11/2004 |
| JP | 2005-238728 | 9/2005 |
| JP | 2005-271543 | 10/2005 |

* cited by examiner

*Primary Examiner* — Shelby Fidler
(74) *Attorney, Agent, or Firm* — Frommer Lawrence & Haug LLP

(57) ABSTRACT

In a liquid-droplet jetting apparatus such as an ink-jet head having a plurality of nozzle rows formed therein, an ink is jetted from one of the nozzle rows and the ink is jetted from another nozzle row concurrently while changing delay times by each of which a jetting timing for the nozzle row is delayed with respect to a jetting timing for the another nozzle row. Then, an optimum image is determined among images formed by the ink jetted from these two nozzle rows, and a delay time in the jetting timings is extracted, among the delay times, which correspond to the optimum image. By determining the delay time in the nozzle rows in such a manner, the variation in jetting characteristics is small in the nozzle rows, thereby realizing satisfactory reproducibility of image.

8 Claims, 17 Drawing Sheets

BEFORE THE METHOD IS APPLIED

AFTER THE METHOD IS APPLIED

JETTING TIMING DETERMINING METHOD, LIQUID-DROPLET JETTING METHOD AND INK-JET PRINTER

CROSS REFERENCE TO RELATED APPLICATION

The present application is a divisional of U.S. patent application Ser. No. 11/604,991 filed on Nov. 28, 2006, now U.S. Pat. No. 7,661,788, which claims priority from Japanese Patent application No. 2005-341345 filed on Nov. 28, 2005, the disclosures of which are incorporated herein by reference in their entirety.

BACKGROUND OF THE INVENTION

1. Field of the Invention

The present invention relates to a jetting timing determining method for determining a timing at which a liquid such as an ink is jetted from a liquid-droplet jetting head such as an ink-jet head, a liquid-droplet jetting method, and an ink-jet printer which jets the ink at a predetermined timing.

2. Description of the Related Art

An example of a technique to utilize an ink-jet head, in which a plurality of nozzles for jetting (discharging) an ink is formed, is described in Japanese Patent Application Laid-open No. 2005-271543.

When the ink is jetted from an ink-jet head as described in Japanese Patent Application Laid-open No. 2005-271543, a difference sometimes arises in ink-jetting characteristics between a case in which the ink is jetted singly or independently from one nozzle (hereinafter referred to as "single jetting" or "independent jetting") within one printing cycle and a case in which the ink is jetted from a plurality of nozzles concurrently (hereinafter referred to as "concurrent jetting") within one printing cycle. For example, jetting speeds at which the ink is concurrently jetted from the nozzles respectively in the concurrent jetting is greatly smaller than the jetting speed in the single jetting in some cases. This makes the variation in the ink jetting speeds to be greater in the concurrent jetting than that in the single jetting. In the concurrent jetting, the ink is jetted concurrently within a period of time (about 0.5 microseconds) having duration to an extent that concentration of an electric power consumption can be avoided.

As a cause to generate, more in the concurrent jetting than in the single jetting, such a variation in the jetting characteristics, there is a phenomenon called "cross talk". The cross talk is a phenomenon in which the vibration or the like, generated in the ink-jet head when the ink is jetted from a certain nozzle, affects or influences the ink jetting from another nozzle different from the certain nozzle. When the ink jetting characteristics are varied among the nozzles upon the concurrent jetting due to the cross talk, there is a fear that an image, formed by the ink jetting, becomes non-uniform. Namely, the reproducibility of the printed image by the ink-jet head is lowered.

SUMMARY OF THE INVENTION

An object of the present invention is to provide a jetting timing determining method with which the variation in jetting speeds is small when the ink is jetted from a plurality of nozzles concurrently, thereby making the reproducibility of the printed image satisfactory.

The inventor of the present invention found out that when the ink is jetted from a plurality of nozzles, different jetting characteristics are obtained depending on a delay time (shift time) intervened in jetting timings for the nozzles.

According to a first aspect of the present invention, there is provided a jetting timing determining method for determining jetting timings at which liquid droplets of a liquid are jetted onto a medium from a liquid-droplet jetting head having a first nozzle and a second nozzle which are to jet the liquid droplets concurrently, the method including: a forming step for forming first images by jetting the liquid droplets from the first and second nozzles at first and second timings, respectively, while delaying the first and second timings with respect to each other by predetermined delay times so that the first images are formed to correspond to the delay times respectively; a step for performing evaluation of the first images; and a first extraction (selection) step for extracting (selecting), based on a result of the evaluation, a delay time, among the delay times, corresponding to an optimum first image among the first images.

According to the first aspect of the present invention, it is possible to determine an optimum delay time intervened in jetting timings for two nozzles which are to jet the liquid droplets concurrently. For example, when an image is formed by jetting liquid droplets of a liquid such as an ink onto a medium, it is possible to perform a sensory evaluation by visual inspection, an image-quality evaluation using a colorimeter, densitometor, or the like, so as to extract an optimum image among the formed images, thereby determining a delay time corresponding to the extracted image. Alternatively, when a liquid such as reagent or the like is jetted and the reagent or the like is transparent, then it is allowable to perform the image-quality evaluation by, for example, measuring a concentrating distribution of the reagent. By determining the delay time corresponding to the optimum image in such a manner, it is possible to jet the liquid droplets in a state in which the cross talk is suppressed between the two nozzles. Note that the term "jetted concurrently" is not limited to a case in which two liquid droplets are jetted exactly concurrently, and it is allowable that the liquid droplets are jetted concurrently within a printing cycle, for example.

In the jetting timing determining method of the present invention, the liquid droplets may be liquid droplets of an ink, and the liquid-droplet jetting head may be an ink-jet head; the ink-jet head may have a plurality of nozzles including the first and second nozzles; the plurality of nozzles may form a plurality of nozzle groups, the plurality of nozzle groups may include a first nozzle group and a plurality of selected nozzle groups each of which is formed of a nozzle group among the plurality of nozzle groups and which is different from the first nozzle group, the first nozzle group may include the first nozzle, and a selected nozzle group among the selected nozzle groups may include the second nozzle;

the forming step may include: a jetting step for jetting the ink concurrently from nozzles, among the plurality of nozzles, included in the first nozzle group while changing among delay-time combinations each including delay times by each of which a jetting timing for the first nozzle group is delayed with respect to a jetting timing for one of the selected nozzle groups; and a step for forming, on the medium, second images corresponding to the delay-time combinations, respectively; and the first extracting step may include a step for extracting a delay-time combination, among the delay-time combinations, which corresponds to an optimum second image among the second images.

When the ink is jetted concurrently from nozzles belonging to different nozzle groups respectively, the ink-jetting characteristics such as jetting speed is sometimes varied, as compared with a case in which the ink is jetted from nozzles belonging only to a certain nozzle group, thereby causing change or variation in ink amount, ink landing position of the ink on a printing medium, and/or the like. When the ink amount, the ink landing position and/or the like are varied, the reproducibility of an image formed by the ink jetting is lowered. According to the present invention, among the combinations of delay times (delay-time combinations) in the jetting timings at each of which the ink is jetted from the nozzles belonging to one of the different nozzle groups, an optimum delay-time combination is determined based on the images formed by the ink jetting, thereby improving the reproducibility of the image formed by the ink-jet head in which such a combination of the delay times is adopted.

In the jetting timing determining method of the present invention, the first extracting step may include an evaluation step for performing a sensory evaluation to visually observe the second images; and a determining step for determining the optimum second image based on a result of the sensory evaluation. In this case, since an optimum image is determined by the visual observation, the optimum image can be easily determined upon considering minute or slight difference between the ink jetting from the first nozzle group and the ink jetting from a selected nozzle group among the selected nozzle groups.

The jetting timing determining method of the present invention may further include a step for forming a third image by jetting the ink concurrently only from the first nozzle group; and the determining step may include: a first comparing step for visually comparing the second images and the third image; and a second extracting step for extracting a second image, among the second images, which is least different from the third image. In this case, an optimum image, which is closest to the image formed by the ink jetted only from the first nozzle group, is extracted. Accordingly, it is possible to extract a delay-time combination in which the lowering in reproducibility of the image, to be formed by the ink jetted from a plurality of nozzle groups, is smallest.

In the jetting timing determining method of the present invention, in the jetting step, the ink may be jetted from the first nozzle group in accordance with a printing data corresponding to a predetermined print image; and the determining step may include a second comparing step for visually comparing difference between the second images, and a third extracting step for extracting two second images which are most different from each other among the second images. In this case, in plurality of images formed by ink jetting performed by changing the delay times in the jetting timings, one image of two images, which are most different from each other among the images, is an optimum image which is least affected by the ink jetting from the nozzles belonging to the selected nozzle groups. Therefore, the optimum image can be easily determined.

In the jetting timing determining method of the present invention, the jetting step may be performed a plurality of times while changing nozzles, among the plurality of nozzles, belonging to one of the first and selected nozzle groups so that each of all the plurality of nozzles belongs to one of the first and selected nozzle groups. In this case, ink jetting is performed with various delay-time combinations while making each of all the nozzles belong to any one of the nozzle groups at least once. Accordingly, a delay time can be determined for each of the nozzles with respect to any other of the nozzles. Namely, for any combination of nozzles among the nozzles, at least one combination of the delay times can be extracted.

In the jetting timing determining method of the present invention, the jetting step may be performed a plurality of times by changing the nozzles belonging to the first nozzle group such that, with respect to all combinations of two extracted nozzles extracted from the plurality of nozzles, one of the two extracted nozzles is included in the first nozzle group and the other of the two extracted nozzles is included in one of the selected nozzle groups and such that the other of the two extracted nozzles is included in the first nozzle group and one of the two extracted nozzles is included in one of the selected nozzle groups. In this case, the ink-jetting step is consequently performed for each of all the combinations of nozzles necessary to calculate, for all the combinations of nozzles, the relationship between the delay times among the nozzles.

The jetting timing determining method of the present invention may further include: a evaluation-value giving step for giving, in the jetting step, evaluation values of an image quality for the second images, respectively; and an estimating step for estimating a delay-time combination, among the delay-time combinations, of delay times by each of which the jetting timing from the first nozzle group is delayed with respect to a jetting timing from one of the selected nozzle groups, different from the first nozzle group, such that an optimum image is to be formed when the ink is jetted concurrently from each of the plurality of nozzle groups, based on the evaluation values given to the second images respectively in the evaluation-giving step.

In this case, it is possible to estimate, from the delay-time combinations for the ink-jetting from the selected nozzle groups, an optimum combination of delay times in the jetting timings for all the plurality of nozzle groups. Therefore, the number of times the ink is jetted is smaller than in a case in which the ink is jetted from all the nozzle groups. In addition, since the optimum delay-time combination is estimated based on the evaluation values on the image quality, it is possible to make estimation based on a systematic evaluation.

The jetting timing determining method of the present invention may further include a confirmation-jetting step for concurrently jetting the ink from each of the plurality of nozzle groups in accordance with the delay-time combination estimated in the estimating step; and when an image formed on the medium by the ink jetted in the confirmation-jetting step has no desired image quality, then in the estimating step, another delay-time combination, which is different from the delay-time combination at which the ink has been jetted in the confirmation-jetting step, may be estimated. In this case, the delay-time combination is estimated after actually confirming, by performing the confirmation-jetting, whether or not the estimated delay-time combination is optimum.

In the jetting timing determining method of the present invention, in the jetting step, ink-jetting may be performed a plurality of times to jet the ink concurrently only from nozzles, among the plurality of nozzles, which belong to one of the selected nozzle groups and to jet the ink concurrently from the nozzles belonging to the first nozzle group, while changing delay times by each of which the jetting timing for one of the selected nozzle groups is delayed with respect to the jetting timing for the first nozzle group. In this case, since the ink is jetted from the nozzles belonging only to one of the selected nozzle groups in one ink jetting, the number of the delay-time combinations is minimum, and thus the number of times for jetting the ink in all the delay-time combinations is minimized. This makes it possible to investigate the optimum combination of delay times in the jetting timings easily and effectively.

In the jetting timing determining method of the present invention, the ink-jet head may have a nozzle surface in which the plurality of nozzles is formed; a plurality of nozzle rows aligned in mutually parallel lines may be formed in the nozzle surface; and each of the nozzle rows may be formed of nozzles, among the plurality of nozzles, each belonging to one of the first and selected nozzle groups. In this case, the delay-time combination and/or the jetting timings may be determined considering the mutual influence of the ink-jetting among the nozzle rows. In addition, in a case that the ink is jetted concurrently from the nozzles belonging to the nozzle groups, respectively, images in linear form are formed on the recording medium. In such a case, it is easy to determine by visual inspection whether or not the formed image is an optimum image.

In the jetting timing determining method of the present invention, in the jetting step, the medium may be moved relative to the ink-jet head while successively jetting the ink onto the medium concurrently from the first nozzle group. In this case, the ink is jetted successively onto the recording medium from a nozzle group corresponding to the first nozzle group while the recording medium is being moved or transported, and consequently, an image formed by the ink jetted from the first nozzle group is a solid-color image. Thus, it is possible to perform a clear visual observation whether or not the ink jetting from one of the selected nozzle groups affects the ink-jetting from the first nozzle group.

In the jetting timing determining method of the present invention, the ink may include a plurality of color inks including a black ink; and in the ink-jetting step, the color inks may be jetted from the first and selected nozzle groups respectively, such that nozzles among the plurality of nozzles which belong to a nozzle row among the plurality of nozzle rows jet a color ink among the color inks, and that nozzles which belong to another nozzle rows different from the nozzle row jet another color ink different from the color ink. In this case, it is possible to investigate the optimum combination of delay times in the jetting timings considering how the difference in color among the color inks affects the ink-jetting speed among the nozzle groups.

In the jetting timing determining method of the present invention, in the first extracting step, the delay-time combination may be extracted such that a jetting timing in nozzles, among the plurality of nozzles, which belong to a nozzle row, among the plurality of nozzle rows, and from which the black ink is jetted, is non-concurrent with a jetting timing in nozzles which belongs to other nozzle rows from which color inks other than the black ink are jetted respectively. In this case, since a delay-time combination is extracted such that the color inks other than the black ink are jetted in an order in which the jetting of the black ink is not intervened therebetween, the delay-time combination may be extracted while focusing on the timings for the color inks other than the black ink which easily affect the jetting speed. In other words, it is possible to investigate the combination of delay times in the jetting timings depending on the difference in usage frequency between the black ink and the other color inks, for example, in a case that the black ink is less frequently used as compared with the other color inks.

In the jetting timing determining method of the present invention, an ink-jetting performed by the ink-jet head may include a plurality of modes which are mutually different in an amount of the ink jetted from the nozzles; and in the first extracting step, the delay-time combination may be extracted for each of the modes. In this case, it is possible to investigate appropriately the combination of delay times in the jetting timings in accordance with the amount of the ink to be jetted.

In the jetting timing determining method of the present invention, an ink-jetting performed by the ink-jet head may include a plurality of modes which are mutually different in an amount of the ink jetted from the nozzles; and in the jetting step, the ink may be jetted from each of the first and selected nozzle groups in a mode in which the ink is jetted in a least amount among the modes. In this case, even for an ink-jet head having jetting modes mutually different in the ink-jetting amount, the ink is jetted focusing on an ink-jetting mode in which the difference in the jetting speeds is most likely to occur. Therefore, it is possible to investigate more appropriately the combination of delay times in the jetting timings.

In the jetting timing determining method of the present invention, the nozzle rows may be formed as four nozzle rows in the ink-jet head. In this case, even when the ink-jet head has not less than four nozzle rows, it is possible to investigate appropriately the combination of delay times in the jetting timings.

According to a second aspect of the present invention, there is provided a liquid-droplet jetting method for jetting liquid droplets of a liquid onto a medium from a liquid-droplet jetting head including a first nozzle and a second nozzle which are to jet the liquid droplets concurrently, the method including: a step for forming first images by jetting the liquid droplets from the first and second nozzles at first and second timings, respectively, while delaying the first and second timings with respect to each other by predetermined delay times so that the first images are formed to correspond to the delay times respectively; a step for performing an image-quality evaluation for each of the first images; a step for determining a delay time, among the delay times, corresponding to an optimum first image among the first images, based on a result of image-quality evaluation; and a step for jetting the liquid droplets from the first and second nozzles by the determined delay time.

According to the second aspect of the present invention, with respect to two nozzles which are to jet the liquid droplets concurrently, it is possible to determine a delay time in the jetting timings, at which the liquid droplet is jetted from the first and second nozzles respectively, based on the quality of the formed images, and thus it is possible to jet the liquid droplets at the jetting timings determined in such a manner. Accordingly, it is possible to suppress the influence by the cross talk caused when the liquid droplets are jetted concurrently from two nozzles, thereby making it possible to form an image with satisfactory quality.

According to a third aspect of the present invention, there is provided an ink-jet printer which jets, onto a medium, liquid droplets of a plurality of color inks including black, cyan, yellow and magenta inks at a predetermined printing cycle, the printer including: a head which includes a plurality of nozzles formed corresponding to the plurality of color inks, respectively, plurality of pressure chambers corresponding to the nozzles, respectively, and a channel which communicates the pressure chambers and the nozzles, respectively; a carriage which carries the head thereon and moves relative to the medium; and a control unit which controls the head so that during the predetermined printing cycle, the plurality of color inks are jetted in an order in which the black ink is jetted first or last among the color inks and the yellow ink is jetted after the cyan and magenta inks.

According to the third aspect of the present invention, in a case that an image is formed by using four color inks of black, cyan, magenta and yellow inks in a normal mode, a fine mode (plain mode) and the like, with respect to the four color inks, the black ink is jetted first or last among the four color inks and with respect to three color inks of yellow, magenta and cyan inks, the yellow ink is jetted lastly, after the magenta and cyan inks have been jetted. By doing so, it is possible to improve the quality of an image obtained. It is allowable that the yellow and black inks are jetted concurrently lastly after the cyan and magenta inks have been jetted. Note that the term "printing cycle" referred herein means a period of time from ink is jetted to form one dot on the medium until the ink is jetted to form next one dot on the medium. For example, when the printing cycle is 100 microseconds, then the black, cyan, magenta and yellow color inks are jetted during a period of 100 microseconds.

BRIEF DESCRIPTION OF THE DRAWINGS

FIGS. 8A to 8D are graphs each showing jetting voltage pulse supplied to the piezoelectric actuator shown in FIG. 3, wherein FIG. 8A shows one jetting voltage pulse, FIG. 8B shows a plurality of jetting voltage pulses, FIG. 8C shows two jetting voltage pulses which are same in timewidth, and FIG. 8D shows two jetting voltage pulses which are different in timewidth;

FIGS. 9A and 9B are graphs each showing a case in which the jetting voltage pulses shown in FIG. 8C is supplied to two nozzles, wherein FIG. 9A shows a case in which the jetting voltage pulses are supplied concurrently to two nozzles, and FIG. 9B shows a case in which the jetting voltage pulses are supplied to the two nozzles at different timings;

FIGS. 13A to 13D show patterns, respectively, which are used for the image formation shown in FIG. 10B, wherein FIG. 13A shows a pattern formed only of large dots, FIG. 13B shows a pattern in which a row of large dots and a row of blanks are alternately aligned, FIG. 13C shows a pattern in which large dots and blanks are randomly arranged so that a ratio of large dots to blanks is 2:1, and FIG. 13D shows a pattern in which large dots, small dots and blanks are randomly arranged in a 1:1:1 ratio;

DESCRIPTION OF THE PREFERRED EMBODIMENTS

In the following, a preferred embodiment of the present invention will be explained. First, an explanation will be given about an ink-jet head which is an object of the jetting-timing determining method of the present invention, and a printer provided with the ink-jet head. Next, a preferred embodiment according to the jetting-timing determining method will be explained.

Figure 1:
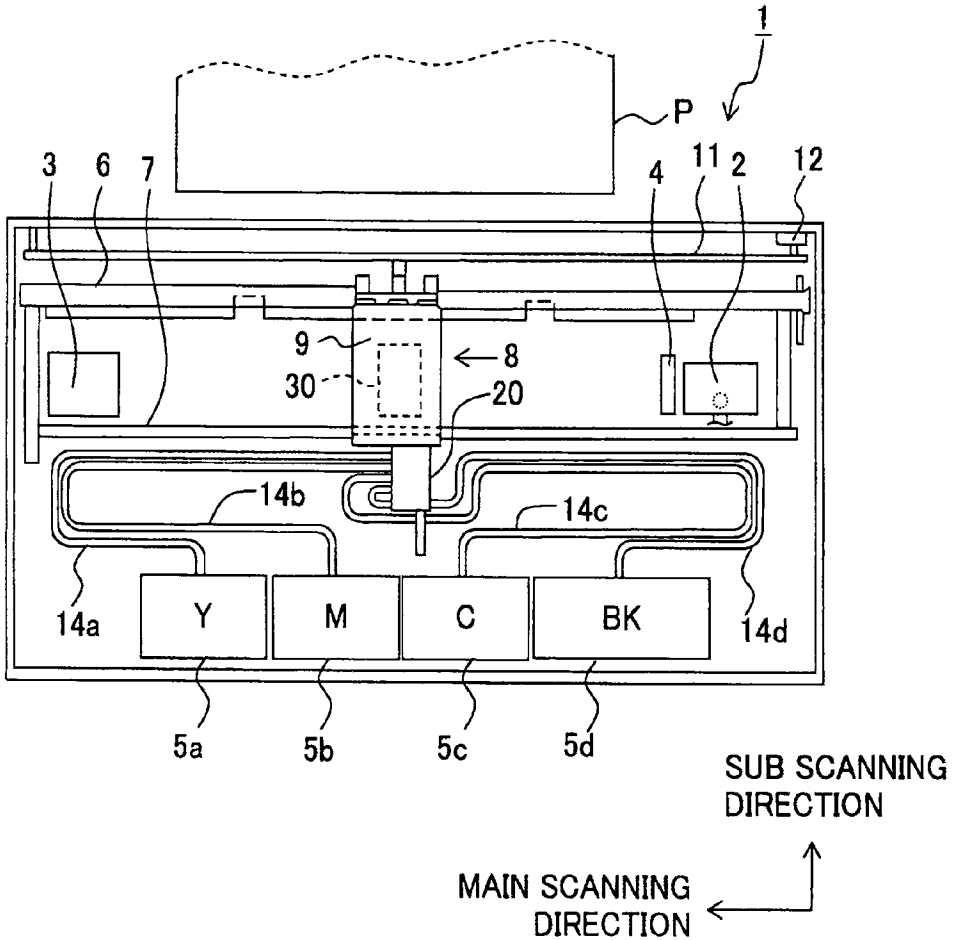
FIG. 1 is a schematic top view showing an example of an ink-jet printer to which the jetting-timing determining method of the present invention is applied.

FIG. 1 shows an example of the ink-jet printer 1 (printer 1) as an object of the jetting-timing determining method of the present invention. FIG. 1 shows the inside of the printer 1 as viewed from above.

In the inside of the printer 1, two guide shafts 6 and 7 are provided. A head unit 8, which serves as a carriage, is arranged in the guide shafts 6 and 7 to be reciprocapable along a main scanning direction (left and right direction in FIG. 1). The head unit 8 has a head holder 9 which is formed of a synthetic resin material. The head holder 9 holds an ink-jet head 30 which performs printing by discharging (jetting) an ink onto a recording paper P fed or transported to a position below the head unit 8.

A carriage motor 12 is arranged in the printer 1. An endless belt 11, which is rotated by being driven by the carriage motor 12, is attached to a driving shaft of the carriage motor 12. The head holder 9 is attached to the endless belt 11, and the head holder 9 reciprocates along the main scanning direction when the endless belt 11 is rotated.

The printer 1 has ink cartridges 5*a*, 5*b*, 5*c* and 5*d*. These ink cartridges 5*a* to 5*d* accommodate a yellow ink, a magenta ink, a cyan ink and a black ink, respectively. Each of the cartridges 5*a* to 5*d* are connected to a tube joint 20 arranged in the head unit 8, via flexible tubes 14*a*, 14*b*, 14*c* and 14*d*, respectively. The inks in the ink cartridges 5*a* to 5*d* are supplied to the head unit 8 via the tube joint 20.

The printer 1 has an ink-absorbing member 3 arranged at a position, in the printer 1, at one end in the main scanning direction defined by the guide shafts 6 and 7. The ink-absorbing member 3 is positioned just below the head unit 8 when the head unit 8 is moved, on the guide shafts 6 and 7, to the one end in the main scanning direction. The ink-absorbing member 3 absorbs the ink jetted, during a flushing operation, from nozzles formed in the head unit 8 on a nozzle surface thereof. The printer 1 has a purge unit 2 arranged between the guide shafts 6 and 7 at a position opposite, in the main scanning direction, to the ink-absorbing member 3. The purge unit 2 sucks the ink from the nozzles during the purge operation.

A wiper 4 is provided on the printer 1 between the guide shafts 6 and 7 at a position adjacent, in the main scanning direction, to the purge unit 2. The wiper 4 wipes the ink, adhered to the nozzle surface, from the nozzle surface.

Figure 2:
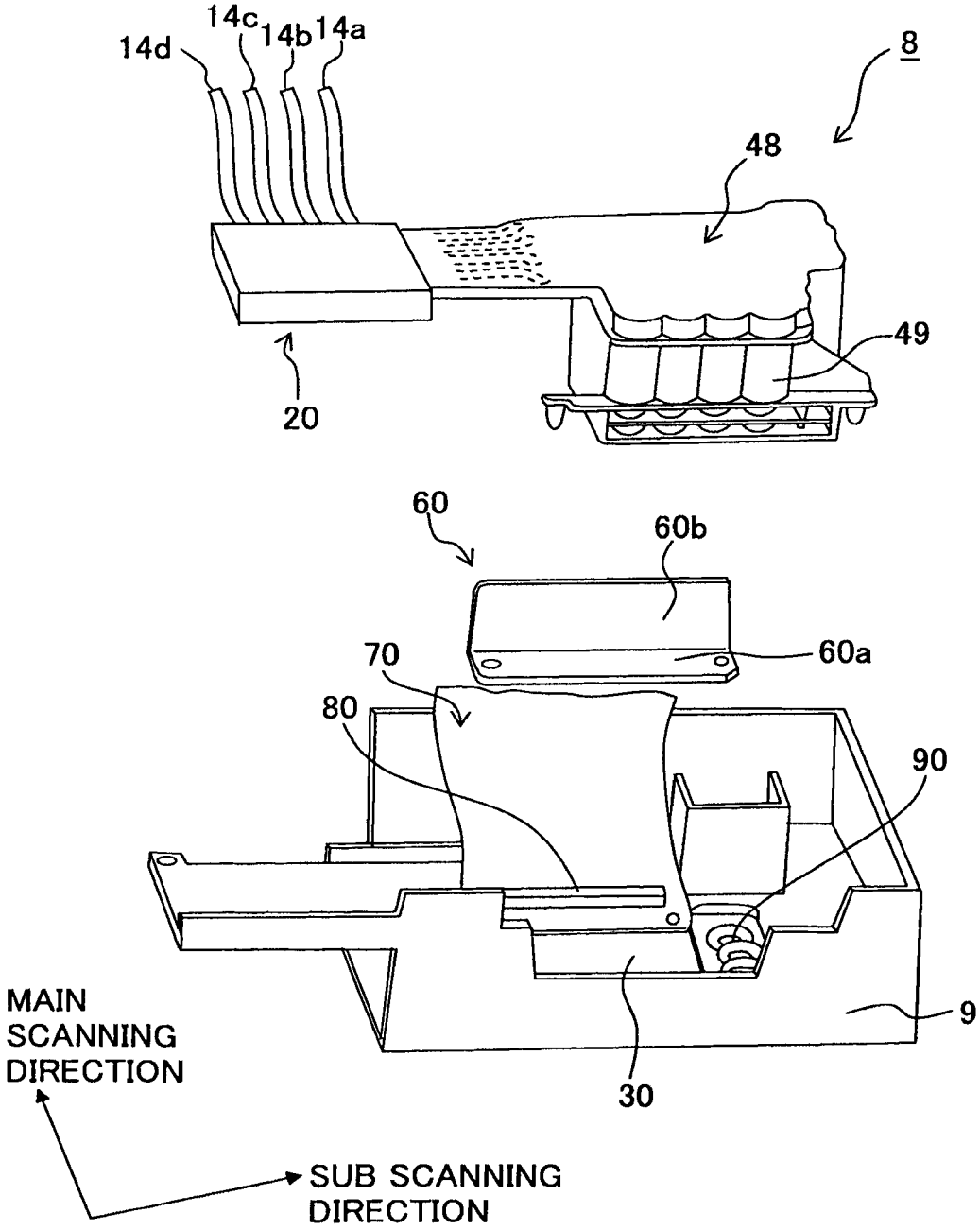
FIG. 2 is an exploded perspective view of a head unit shown in FIG. 1.

An explanation will be given about the head unit 8. FIG. 2 shows the head unit 8 in a state that a buffer tank 48 and a heat sink 60 are detached from the head holder 9.

The head holder 9 is formed in a substantially box shape which is open toward a side (upper side in FIG. 2) in which the head holder 9 accommodates or receives the buffer tank 48 (ink channel unit) therein. The ink-jet head 30 is arranged in the bottom portion of the head holder 9. The buffer tank 48 is accommodated in the head holder 9 to be positioned above the ink-jet head 30.

The tube joint 20 is connected to a portion, on the upper surface of the buffer tank 48, in the vicinity of one end thereof. As described above, the tube joint 20 is connected to the ink cartridges 5*a*, 5*b*, 5*c* and 5*d* via the tubes 14*a*, 14*b*, 14*c* and 14*d*, respectively. The inks are supplied to the buffer tank 48 from the ink cartridges 5*a* to 5*d* via the tubes 14*a* to 14*d*, respectively. Although not shown in the drawing, four ink outlet ports are provided in the lower surface of the buffer tank 48. These ink outlet ports are connected to four ink supply ports 91*a*, 91*d*, 91*c* and 91*d*, respectively, arranged in the ink-jet head 30 via a seal member 90, as will be described later on.

The head holder 9 has the heat sink 60. The heat sink 60 has a horizontal portion 60*a* extending in a sub scanning direction, and a vertical portion 60*b* rising upward from one end of the horizontal portion 60*a*. As shown in FIG. 2, each of the horizontal portion 60*a* and the vertical portion 60*b* is formed to have a plate shape which is long in the sub scanning direction.

From the head holder 9, a Flexible Printed Circuit (FPC) 70 (to be described later) is drawn upward to pass through a gap defined in the bottom portion of the head holder 9. One end of the FPC 70 is connected to a head body 25 of the ink-jet head 30, and the other end of the FPC 70 is electrically connected to a control IC (control unit) 83 of the printer 1. The control unit 83 of the printer 1 controls, via the FPC 70, the ink jetting from the head body 25, based on an image data. A driver IC 80 is arranged in the FPC 70, at an intermediate portion between the one end of the FPC 70 connected to the head body 25 and the other end connected to the control unit 83. Note that the control unit of the printer may be provided outside the head holder 9.

Figure 3:
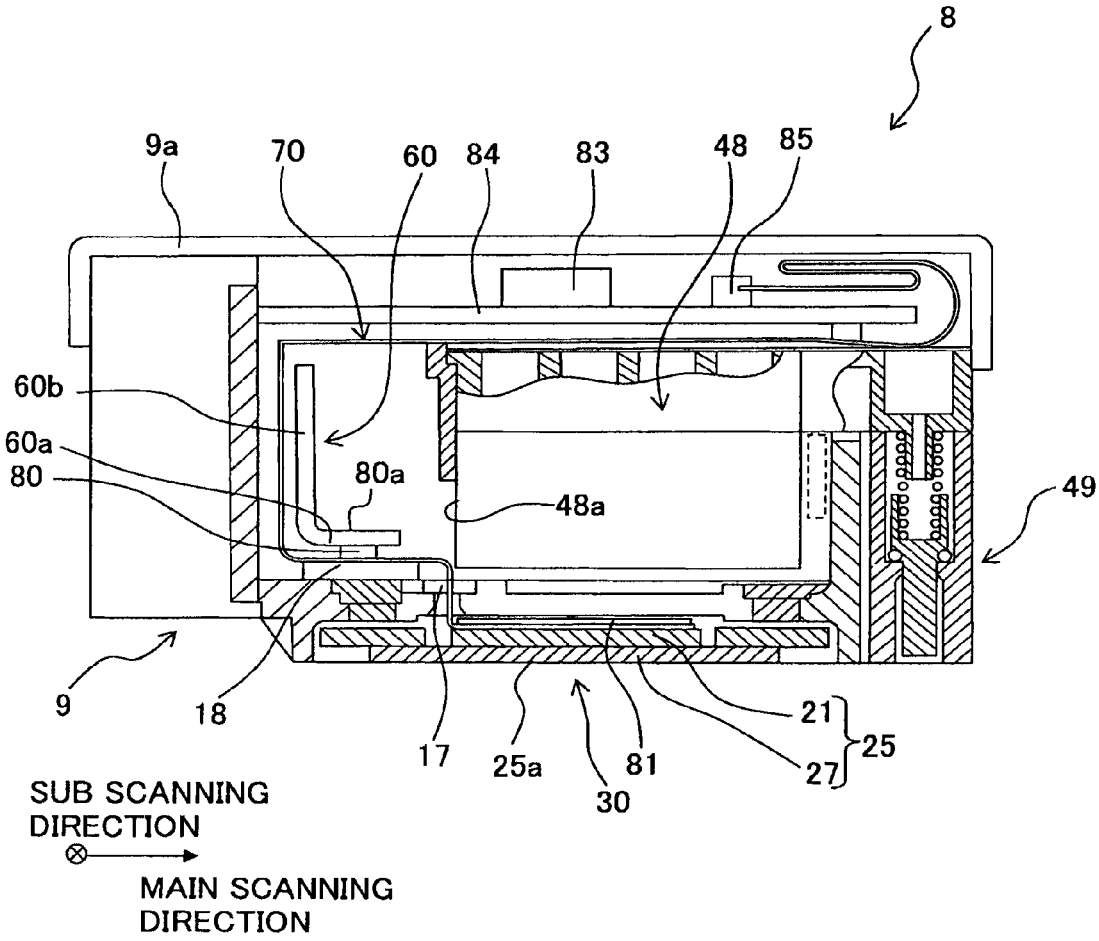
FIG. 3 is a vertical cross-sectional view of the head unit shown in FIG. 1.

FIG. 3 is a vertical sectional view of the head unit 8 taken along the main scanning direction. FIG. 3 shows the head unit 8 in a state that the buffer tank 48 and the heat sink 60 are accommodated in the head unit 8.

The heat sink 60 is fixed to a position (the left side in FIG. 3) which is opposite to the buffer tank 48 in the main scanning direction, and which is adjacent to a side wall 48*a* of the buffer tank 48. A surface of the vertical portion 60*b* in the heat sink 60 faces the side wall 48*a*. The horizontal portion 60*a* of the heat sink 60 is arranged in the head holder 9 on the bottom portion thereof, so that short side of the horizontal portion 60*a* extends in the main scanning direction.

A control board 84, on which a connector 85 and electrical parts such as a capacitor 83 are mounted, is arranged at a position above the buffer tank 48. The upper side of the control board 84 is covered by a cover 9*a* which is to be the upper cover of the head holder 9.

An exhaust unit (air discharge unit) 49 is arranged in the buffer tank 48 at a side surface thereof at one side in the main scanning direction (right side in FIG. 3). The exhaust unit 49 discharges the air accumulated in the buffer tank 48 to the outside.

The ink-jet head 30, arranged on the bottom portion of the head holder 9, has the head body 25. The head body 25 is firmly fixed to the bottom portion of the head holder 9, as will be described later, and has a nozzle surface (bottom surface) 25*a*. The nozzle surface 25*a*, in which a plurality of nozzles is formed, is arranged to the head body 25 such that the nozzle surface 25*a* is exposed downward to the outside of the head holder 9. The head body 25 has a piezoelectric actuator 21 and a channel unit 27 which will be described later on.

The FPC 70 is electrically connected to the piezoelectric actuator 21 at a portion of the FPC 70 in the vicinity of one end thereof. The other end of the FPC 70 is drawn up to and is electrically connected to the connector 85, which is provided above the buffer tank 48, via the following route. First, the other end of the FPC 70 is drawn upward passing through a hole 17 formed in the bottom portion of the head holder 9. Then, the drawn FPC 70 advances upward passing through a gap defined between the heat sink 60 and an inner surface of the head holder 9. Afterwards, the FPC 70 extends upward along an inner surface on one side in the head holder 9, is bent at a portion in the vicinity of the control board 84, further to extend in the main scanning direction along the lower surface of the control board 84. Further, the FPC 70 is bent upward at a portion in the vicinity of an inner surface on the other side in the head holder 9, passes through a gap defined between an end portion of the control board 84 and the other inner surface of the head holder 9 to be drawn on the upper surface, of the control board 84, to the side in which the connecter 85 is formed. Note that the connector 85 may be electrically connected to the control unit of the printer 1 in an unillustrated route in a case that the control unit of the printer is provided outside the head holder 9.

The driver IC 80 is arranged in the FPC 70 as described above. The driver IC 80 is arranged in the FPC 70 on the surface thereof facing the horizontal portion 60*a* of the heat sink 60, to be located at a position below the heat sink 60. Further, an elastic member 18 is arranged at a position below the driver IC 80. The FPC 70 is pressed by the elastic member 18 so that upper surface of the driver IC 80 makes contact with the horizontal portion 60*a* of the heat sink 60. The driver IC 80, when excessively heated, releases heat via the heat sink 60.

A heat-conducting body 81 is arranged in the FPC 70 at an area thereof facing the piezoelectric actuator 21. The heat-conducting body 81 is an aluminum plate with a uniform thickness and has a shape which is substantially same as that of the upper surface of the piezoelectric actuator 21. The heat-conducting body 81 releases the heat, generated from the piezoelectric actuator 21 and from the FPC 70 in the portion thereof facing the piezoelectric actuator 21.

Figure 4:
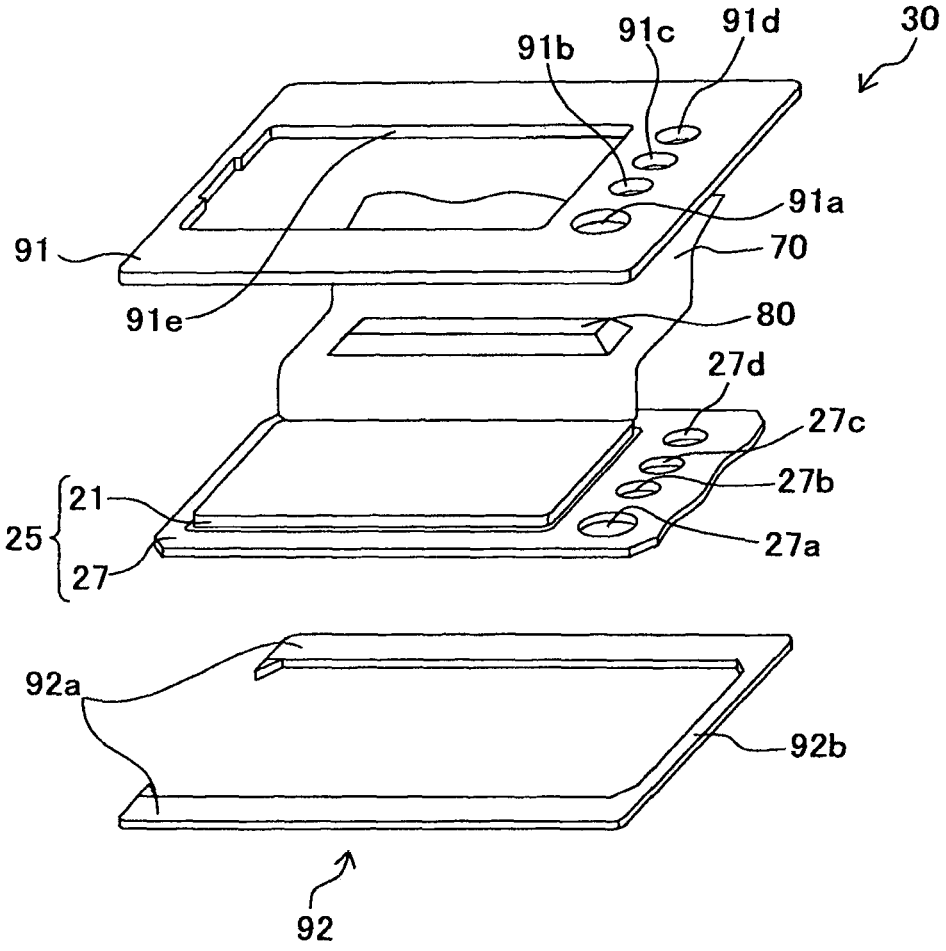
FIG. 4 is an exploded perspective view of the ink-jet head shown in FIG. 2.

Next, the ink-jet head 30 will be explained. FIG. 4 is an exploded perspective view of the ink-jet head 30. The ink-jet head 30 has the head body 25, a reinforcing frame 91 and a protective frame 92. FIG. 4 shows the head body 25, the reinforcing frame 91 and the protective frame 92.

The head body 25 has the piezoelectric actuator 21 and the channel unit 27. As will be described later, the channel unit 27 has a stack formed by stacking a plurality of sheet members which have a same rectangular planar shape (see FIG. 5). Ink supply ports 27*a*, 27*b*, 27*c* and 27*d* are formed in the channel unit 27 at one end in the longitudinal direction thereof. The ink supply ports 27*a* to 27*d* are arranged along a short direction of the head body 25 such that the ink supply ports are isolated and away from one another. The inks are supplied from the buffer tank 48 to the channel unit 27 via the ink supply ports 27*a* to 27*d*. A plurality of nozzles, which jet (discharge) the ink, is formed in the channel unit 27 on the lower surface thereof. Accordingly, the lower surface of the channel unit 27 corresponds to the nozzle surface 25*a*. The ink channel, from the ink supply ports 27*a* to 27*d* and communicating with the nozzles, is formed in the inside of the channel unit 27.

Further, the piezoelectric actuator 21 (to be described later) is arranged on the upper surface of the channel unit 27, at a position where the piezoelectric actuator 21 avoids (does not interfere or overlap with) the ink supply ports 27*a* to 27*d*. The piezoelectric actuator 21 forms a part of inner wall (pressure chambers, to be explained later) of the ink channel formed in the channel unit 27, and applies a pressure to the ink in the ink channel, thereby jetting the ink from the nozzles. The FPC 70 is electrically connected to the piezoelectric actuator 21, as described above.

The reinforcing frame 91 is a metal member having a rectangular shape in a plan view. An opening 91*e* is formed in the reinforcing frame 91 to correspond to the piezoelectric actuator 21 in the head body 25. The opening 91*e* has a shape substantially same as that of the piezoelectric actuator 21, and has a size greater to some extent than that of the piezoelectric actuator 21, as a whole. In addition, the opening 91*e* has the size smaller to some extent than that of the channel unit 27, as a whole. Namely, the opening 91*e* has an opening area greater to some extent than the contour of the piezoelectric actuator 21 and is smaller to some extent than the contour of the channel unit 27. Further, the opening 91*e* is formed in the reinforcing frame 91 to be offset in the longitudinal direction of the reinforcing frame 91, and at a position near to the center, in the short direction, of the reinforcing frame 91.

Ink supply ports 91*a*, 91*b*, 91*c* and 91*d* are formed to penetrate through the reinforcing frame 91 in the thickness direction, at a portion of the reinforcing frame 91 on a side of an one end in the longitudinal direction. The ink supply ports 91*a* to 91*d* are formed to correspond to the ink supply ports 27*a* to 27*d*, respectively, in the channel unit 27. Further, the ink supply ports 91*a* to 91*d* are formed along the short direction of the reinforcing frame 91 so as to be isolated and away from one another. The ink supply ports 91*a* to 91*d* have shapes which are same as those of the ink supply ports 27*a* to 27*d*, respectively, formed in the head body 25.

The protective frame 92 is a metal plate member formed to have a "U"-shape in a plan view. The protective frame 92 has two arm portions 92*a*, in the U-shaped form thereof, which are parallel to each other and have a length substantially same as that in a length in the longitudinal direction of the reinforcing frame 91. The reinforcing frame 92 further has a support portion 92*b* which supports the two arm portions 92*a*. The support portion 92*b*, which is orthogonal to the arm portions 92*a*, has a length substantially same as the length in the short direction of the reinforcing frame 91. In a plane including the cross section of the protective frame 92, an area, surrounded by the horizontal U-shaped protective frame 92, has a shape substantially same as that of the main body 25 and is greater in size to some extent than that of the head body 25.

The ink-jet head 30 is formed by adhering the head body 25, the reinforcing frame 91 and the protective frame 92 together. The head body 25 and the reinforcing frame 91 are adhered so that the piezoelectric actuator 21 is accommodated inside the through hole (opening 91*e*) formed in the reinforcing frame 91, and that the lower surface of the reinforcing frame 91 and the periphery portion of the piezoelectric actuator 21 arranged on the upper surface of the channel unit 27 are in contact with each other, thereby exposing the upper surface of the piezoelectric actuator 21 upwardly in the opening 91*e* in the reinforcing frame 91. Further, the protective frame 92 is adhered to the lower surface of the reinforcing frame 91 so that the channel unit 27 is surrounded by the protective frame 92. In other words, the nozzle surface 25*a* of the channel unit 27 is exposed downwardly in an area inside the U-shaped protective frame 92.

When the reinforcing frame 91 and the head body 25 are adhered together, the ink supply ports 27*a* to 27*d* are positioned such that the ink supply ports 27*a* to 27*d* are communicated with the ink supply ports 91*a* to 91*d*, respectively.

Figure 5A:
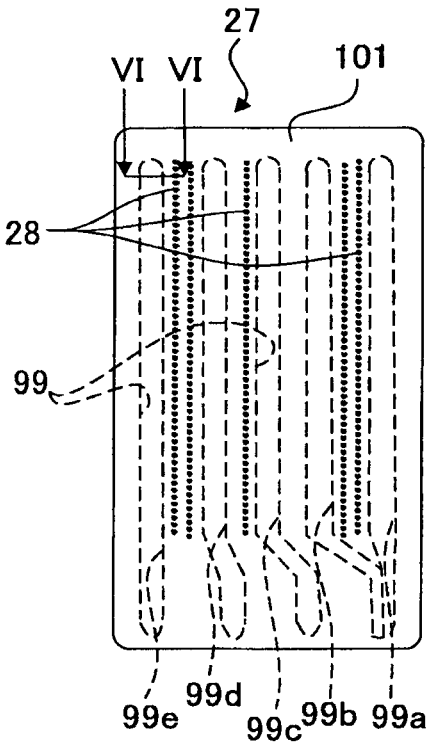
FIGS. 5A and 5B are bottom and top views, respectively, of a channel unit shown in FIG. 2.
Figure 5B:
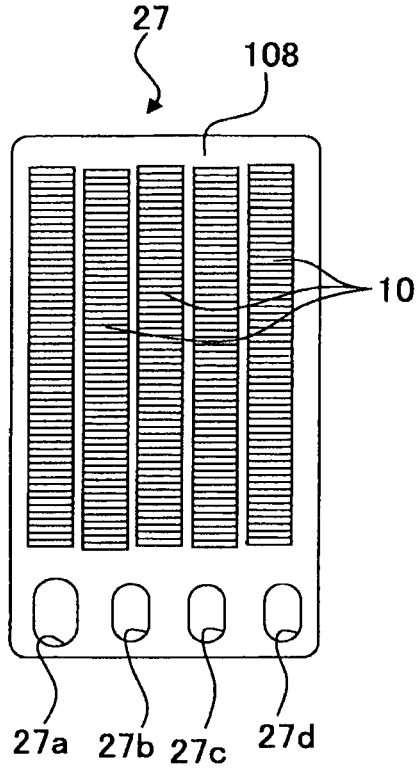

FIGS. 5A and 5B are bottom and top views, respectively, of the channel unit 27. As described above, the lower surface of the channel unit 27 is the nozzle surface 25*a* in which a plurality of nozzles 28 are formed. As shown in FIG. 5A, the nozzles 28 are arranged in a staggered manner along the longitudinal direction of the channel unit 27, thereby forming five nozzle rows 58. In the channel unit 27, five common ink chambers 99*a*, 99*b*, 99*c*, 99*d* and 99*e* are formed to extend along the nozzle rows 58, respectively. Each of the common ink chambers 99*a* to 99*e* is formed in the channel unit 27 in an area not overlapping, in the thickness direction of the channel unit 27, with any one of the nozzles 28, such that the common ink chambers 99*a* to 99*e* avoid the nozzle rows 58, respectively. In the channel unit 27, individual ink channels are further formed. Each of the individual ink channels communicates with one of the nozzles 28 via one of the common ink chambers 99*a* to 99*e*. The ink, filled in each of the common ink chambers 99*a* to 99*e*, is supplied to the nozzles 28 via the individual ink channels, respectively.

As shown in FIG. 5B, pressure chambers 10 are formed in the upper surface of the channel unit 27. Each of the pressure chambers 10 is a cavity which is open, in the upper surface of the channel unit 27, to the outside of the channel unit 27. These pressure chambers 10 are arranged in five rows in a staggered manner, and correspond to the nozzles 28, respectively. Each of the pressure chambers 10 constructs a part of one of the individual ink channels communicating from one of the common ink chambers 99*a* to 99*e* to the nozzles 28, respectively. As will be described later, by adhering the piezoelectric actuator 21 to the upper surface of the channel unit 27, the openings of the pressure chambers 10 are covered by the piezoelectric actuator 21. In other words, the surface, of the piezoelectric actuator adhered to the channel unit 27, forms one of inner surfaces of each of the pressure chambers 10.

The ink supply ports 27*a* to 27*d* are formed in the upper surface of the channel unit 27. Further, ink channels (not shown), communicating with the common ink chambers 99*a* to 99*e* respectively, are formed in the channel unit 27. Via such ink channels, the ink supply port 27*a* communicates with the common ink chambers 99*a* and 99*b*; and the ink supply ports 27*b* to 27*d* communicate with the common ink chambers 99*c* to 99*e*, respectively. The ink, supplied to the ink supply port 27*a* is filled in the common ink chambers 99*a* and 99*b*; and the inks supplied to the ink supply ports 27*b* to 27*d* are filled in the common ink chambers 99*c* to 99*e*, respectively.

Figure 5C:
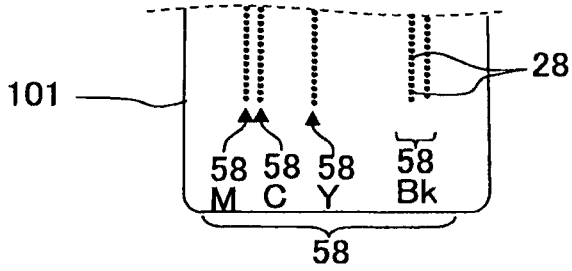
FIG. 5C is a partially enlarged view of FIG. 5A.

The ink-jet head 30 of the present invention is assumed to be an ink-jet head jetting a plurality of color inks. FIG. 5C is a partial view of the lower surface of a nozzle plate 101. FIG. 5C shows a relationship among the nozzle rows 58 formed in the nozzle plate 101 and the colors of the inks jetted from the nozzle rows 58, respectively. As described above, five nozzle rows 58 are formed in the nozzle plate 101. A color ink, among the color inks, is jetted from nozzles 28 belonging to a nozzle row 58 among the nozzle rows 58. For example, a magenta ink is jetted from a nozzle row 58M aligned most closely along one end in the short direction of the nozzle plate 101. Further, in an order nearer to the nozzle row 58M, a cyan ink is jetted from a nozzle row 58C disposed most closely to the nozzle row 58M, a yellow ink is jetted from a nozzle row 58Y disposed next closely to the nozzle row 58M with respect to the nozzle row 58C, and a black ink is jetted from a nozzle row 58Bk disposed least closely to the nozzle row 58M.

Figure 6:
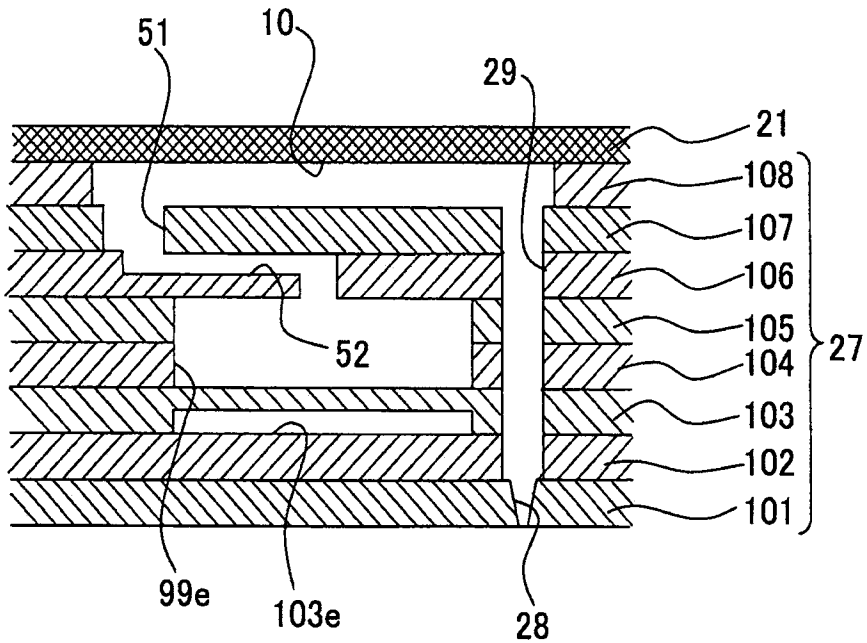
FIG. 6 is a cross sectional view of the channel unit shown in FIG. 2, taken along a line VI-VI.

FIG. 6 is a vertical cross-sectional view along VI-VI line in FIG. 5A. FIG. 6 shows a state in which the piezoelectric actuator 21 is adhered to the channel unit 27. Although FIG. 6 shows a vertical section of a portion in the vicinity of the common ink chamber 99*e*, portions in the vicinity of the common ink chambers 99*a* to 99*d*, respectively, are constructed in a same manner. In the following, although a channel unit communicating with the common ink chamber 99*e* is explained as an example, channel units communicating with the common ink chambers 99*a* to 99*d*, respectively, are constructed in a similar manner.

As shown in FIG. 6, the channel unit 27 is a stack in which a plurality of plates is stacked in laminated layers. A plurality of channel holes constructing the common ink chamber 99*e*, the nozzles 28, and the ink channels are formed in each of the plates. The channel unit 27 is formed by stacking the plates such that these channel holes are mutually communicated to form the common ink chamber 99*e*, the ink channels, and the like. These plates are formed of a metallic material, a polyimide resin material, or the like.

The plates constructing the channel unit 27 includes the nozzle plate 101, a cover plate 102, a damper plate 103, two manifold plates 104 and 105, an aperture plate 106, a supply plate 107 and a cavity plate 108, and these plate are stacked in an order in the channel unit 27. The nozzles 28 are formed in the nozzle plate 101, and the pressure chambers 10 are formed in the cavity plate 108. Each of the remaining plates, sandwiched between the plates 101 and 108, has channel holes constructing the individual ink channels formed therein. Each of the individual ink channels starts from the common ink chamber 99*e* and reaches one of the nozzles 28 via one of the pressure chambers 10.

Channel holes constructing the common ink chamber 99*e* are formed in the manifold plates 104 and 105. Apertures 52 (throttled portions) are formed in the aperture plate 106. Each of the apertures 52 is communicated, at one end thereof, with the common ink chamber 99*e*. The apertures 52 are extended along the short direction of the channel unit 27. The cross-sectional area of each of the apertures 52 (a cross-sectional area in a direction orthogonal to a direction in which the aperture extends) is set to a predetermined dimension. In other words, the cross-sectional shape, cross-sectional area and length of the aperture 52 are determined so that the ink flows in the aperture 52 in a specific (predetermined) channel resistance. This limits the flow of ink which is about to flow back to a side of the common ink chamber 99*e* from one of the pressure chambers 10 when ink is jetted. Further, through holes 51 are formed in the supply plate 107. Each of the through holes 51 communicates, at one end thereof, with one of the pressure chambers 10 and communicates, at the other end thereof, with the other end of one of the apertures 52.

Furthermore, through holes 29 are formed in each of the plates 102 to 107. The through holes 29 formed in these plates 102 to 107 are mutually communicated, and the through holes 29, formed in the plates 102 and 107, communicates with one of the pressure chambers 10 and one of the nozzles 28, respectively. This forms a linear ink channel extending along a direction in which the plates are stacked (stacking direction) from one of the pressure chambers 10 and reaching the one of the nozzles 28.

The ink is jetted as described below, through the ink channels formed by mutually communicating the channel holes which are formed in the plates in such a manner. First, the ink which flowed from the common ink chamber 99*e* flows, via one of the apertures 52 and one of the through holes 51, toward the one end of the pressure chamber 10 disposed above the common ink chamber 99*e*. Then, the ink flows in the pressure chamber 10 and toward the other end of the pressure chamber 10, from where the ink flows downwardly through the through hole 29, to be jetted from the nozzle 28.

A damper groove 103*e* is formed in the damper plate 103 in a surface thereof facing the spacer plate 102, at a position corresponding to the common ink chamber 99*e*. The damper groove 103 is a groove formed such that a vertical cross section of the damper groove 103 along the short direction of the channel unit 27 is a recess-shaped groove; and that the damper groove 103 has same shape and size in plan view with those of the common ink chamber 99*e*. In addition to the damper groove 103*e*, damper grooves 103*a* to 103*d* are formed in the damper plate 103 at positions corresponding to the common ink chambers 99*a* to 99*d* (damper grooves 103*a* to 103*d* are not shown in the drawing). The damper grooves 103*a* to 103*d* have sizes and shapes in plan view as those of the common ink chambers 99*a* to 99*d*, respectively.

Figure 7:
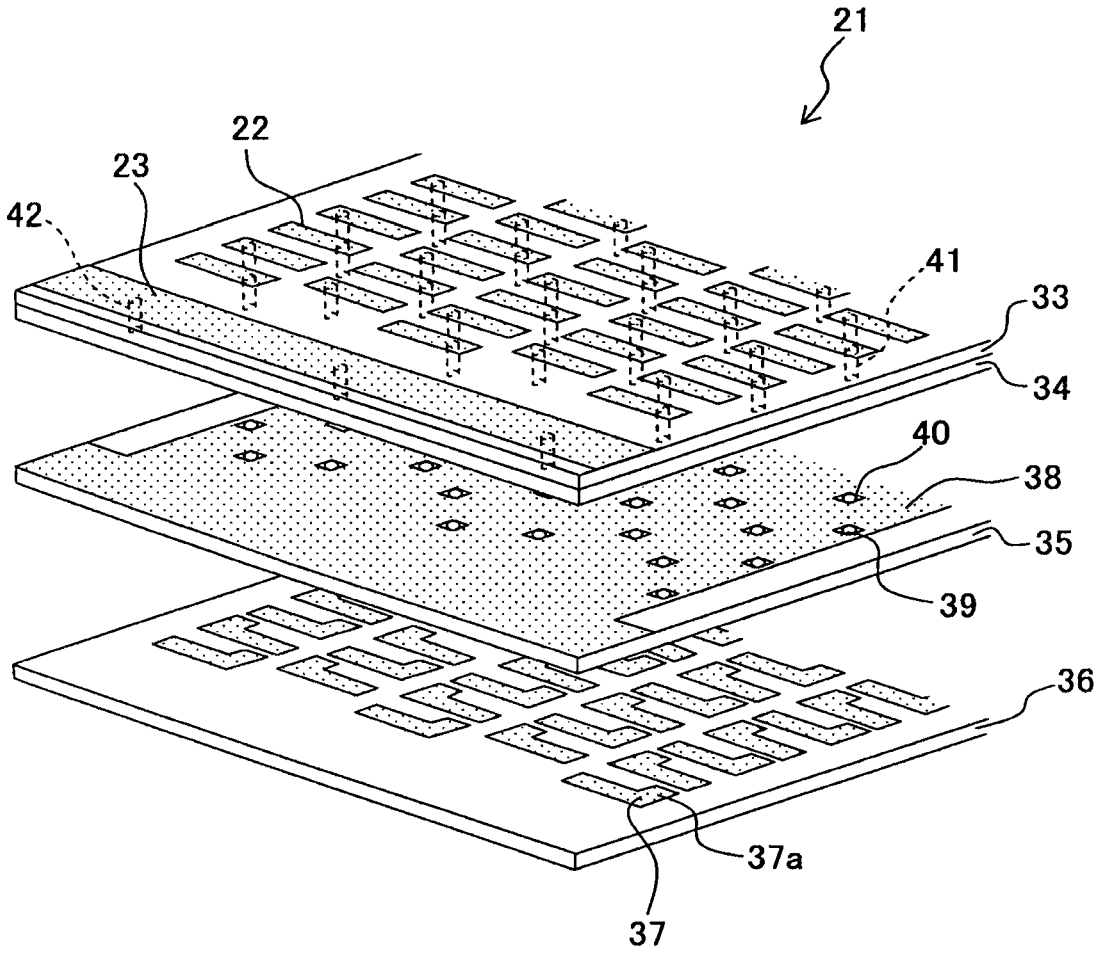
FIG. 7 is an exploded perspective view of a piezoelectric actuator shown in FIG. 3.

Next, the piezoelectric actuator 21 will be explained. FIG. 7 is an exploded perspective view of the piezoelectric actuator 21.

The piezoelectric actuator 21 is formed by stacking two insulating sheets 33, 34 and two piezoelectric sheets 35, 36. A plurality of individual electrodes 37 are formed, on the upper surface of the piezoelectric sheet 36, at positions facing the pressure chambers 10, respectively. These individual electrodes 37 are arranged in five rows, along the longitudinal direction of the piezoelectric sheet 36, in a staggered manner corresponding to the rows of the pressure chambers 10. Each of the individual electrodes 37 has a rectangular portion which is long in a plan view in the short direction of the piezoelectric sheet 36. Further, each of the individual electrodes 37 has an extended portion 37*a* drawn from one end, in the longitudinal direction of the individual electrode 37, and extended in the longitudinal direction of the piezoelectric sheet 36. The extended portion 37*a* is extended in the piezoelectric sheet 36 up to an area at which the extended portion 37*a* faces none of the pressure chambers 10.

A common electrode 38 is formed on the upper surface of the piezoelectric sheet 36 to cover the pressure chambers 10. On the upper surface of the piezoelectric sheet 35, a plurality of non-electrode areas 39 is formed in which the common electrode 38 is not formed (in which the common electrode 38 is partially absent). Through holes 40, which penetrate through the piezoelectric sheet 35 in the thickness direction thereof, are formed in the non-electrodes areas 39, respectively. In each of the through holes 40, an electrically conductive member is filled. The conductive member is electrically insulated from the common electrode 38. The non-electrode areas 39 are arranged at positions each facing the extended portion 37*a* of one of the individual electrodes 37.

On the upper surface of the insulating sheet 33 which is the uppermost layer of the stacked insulating sheets (namely, on the upper surface of the piezoelectric actuator 21), surface electrodes 22 which correspond to the individual electrodes 37 respectively and a surface electrode 23 are arranged. Each of the surface electrodes 22 is formed in the insulating sheet 33 at an area in which the surface electrode 22 does not face any one of the pressure chambers 10, but faces one of the through holes 40 (or faces the extended portion 37*a* of one of the individual electrodes 37). Further, the surface electrodes 22 are arranged in five rows, along the longitudinal direction of the piezoelectric actuator 21, in a staggered manner corresponding to the individual electrodes 37, respectively. The surface electrode 23 is arranged in the insulating sheet 33 at a portion in the vicinity of one end, in the longitudinal direction, of the insulating sheet 33 and is extended in the short direction of the piezoelectric actuator 21.

A plurality of continuous holes 41 is formed in the insulating sheets 33, 34 penetrating through the thickness direction of the insulating sheets 33, 34. The continuous holes 41 are formed at an area facing the surface electrodes 22 and the extended portions 37*a*, so that the continuous holes 41 are positioned to face the through holes 40, respectively. Further, three continuous holes 42 are formed in the insulating sheets 33, 34 at an area facing the surface electrode 23 and the common electrode 38, such that the continuous holes 42 are arranged along the short direction of the insulating sheets 33, 34 and are isolated and away from one another. An electrically conductive member is filled in each of the continuous holes 41 and 42.

The piezoelectric actuator 21 has a stacked structure in which the insulating sheets 33, 34 and the piezoelectric sheets 35, 36, with the construction as described above, are stacked from above in this order. In such a stacked structure, the sheet-shaped members are stacked while the through holes 40 and the continuous holes 41 are positioned to face one another, thereby communicating the through holes 40 and the continuous holes 41 respectively so as to form a plurality of through holes penetrating the insulating sheets 33, 34 and piezoelectric sheet 35. Since the conductive member is filled in each of the through holes as described above, the surface electrodes 22 and the individual electrodes 37 are electrically connected, respectively. In addition, since the conductive material is also filled in the continuous holes 42 formed in the insulating sheets 33, 34 as described above, the surface electrode 23 and the common electrode 38 are electrically connected.

With such a construction, the respective individual electrodes 37 of the piezoelectric actuator 21 are connected, via the surface electrodes 22, to unillustrated individual wirings in the FPC 70. Further, the common electrode 38 is connected, via the surface electrode 23, to an unillustrated common wiring of the FPC 70. Furthermore, the individual wirings are connected to the driver IC 80.

On the other hand, the drive IC 80 converts a print signal, serially transmitted from the control section of the printer 1, to a parallel signal which is corresponded to each of the individual electrodes 37 of the piezoelectric actuator 21. Further, the driver IC 80 generates, based on the print signal, a drive signal having a predetermined voltage pulse and outputs or transmits the generated drive signal to each of the individual wirings connected to one of the individual electrodes 37. The common wiring is always kept at ground electric potential.

With this configuration, the drive voltage (drive signal) from the driver IC 80 is selectively applied between any individual electrode 37 and the common electrode 38. When a predetermined voltage is applied between a certain individual electrode 37 and the common electrode 38, a distortion (deformation) in the stacking direction is generated in the piezoelectric sheets at an active portion thereof which is sandwiched by the certain individual electrode 37 and the common electrode 38. Then, the distortion generated in the active portion applies a pressure to the ink in a pressure chamber, corresponding to the certain individual electrode 37, thereby jetting the ink from a nozzle 28 corresponding to the pressure chamber 10.

Figure 8A:
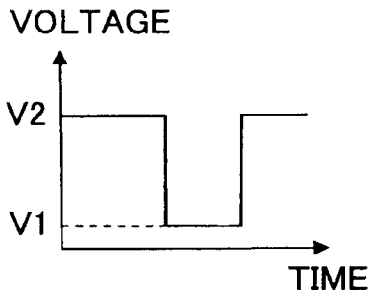

FIGS. 8A to 8D each shows a jetting voltage pulse applied between the individual and common electrodes 37, 38 in the piezoelectric actuator 21 at the time of ink jetting. FIG. 8A shows a waveform of a most basic jetting voltage pulse upon jetting the ink by using the piezoelectric actuator 21 in a so-called pulling ejection manner. By applying this jetting voltage pulse, the ink is jetted from the nozzle 28 as described below.

As shown in FIG. 8A, the value of a voltage between the individual electrode 37 and the common electrode 38 is maintained, for example, to V2 (V2>0) before the ink is jetted. Accordingly, the piezoelectric actuator 21 is deformed at a portion thereof, which corresponds to a certain individual electrode 37 to which the voltage is applied, so as to project toward a pressure chamber 10 at the portion corresponding to the certain individual electrode 37. When the voltage pulse shown in FIG. 8A is applied, then the value of the voltage between the individual electrode 37 and the common electrode 38 changes once to V1 which is smaller than V2. At this time, the portion of the piezoelectric actuator 21 projected toward the pressure chamber 10 is deformed so as to withdraw or draw back in a direction from the inside to the outside of the pressure chamber 10. This increases the volume of the pressure chamber 10 quickly, thereby generating a negative pressure wave in the pressure chamber 10.

The negative pressure wave thus generated is propagated in a direction toward the outside of the pressure chamber 10. Then, the pressure wave is reflected, for example, in the aperture 52, and returned to the pressure chamber 10 as a positive pressure wave. On the other hand, as shown in FIG. 8A, the voltage between the individual electrode 37 and the common electrode 38, which was once changed to V1, is returned to V2 again at a predetermined time interval (after a predetermined period of time is elapsed). At this time, the volume of the pressure chamber 10 is decreased quickly to be returned to the state before the ink jetting, thereby generating a positive pressure wave in the pressure chamber 10.

In this case, a duration of a period of time when the voltage between the individual electrode 37 and the common electrode 38 is V1 is adjusted to be a duration of a period of time from when the above-described negative pressure wave is generated and until the pressure wave is returned to the pressure chamber 10 as the positive pressure wave. Therefore, the positive pressure wave generated when the increased volume of the pressure chamber 10 is returned to its original volume and the positive pressure wave reflected and returned to the pressure chamber 10 are overlapped with each other, and the overlapped positive pressure waves are propagated in a direction from the pressure chamber 10 toward the nozzle 28. Thus, the ink is jetted from the nozzle 28.

Figure 8B:
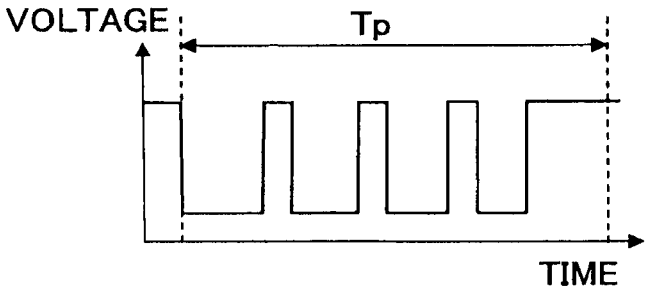

In actual ink jetting, the basic jetting pulse shown in FIG. 8A is emitted a plurality of times or emitted as a plurality of basic jetting pulses, as shown in FIG. 8B, and applied between the electrodes. Accordingly, an ink droplet is jetted from the nozzle 28 in an amount greater than in a case in which only one basic voltage pulse is applied. Note that the voltage pulse rows shown in FIGS. 8A to 8D respectively, are used upon jetting an ink droplet corresponding to one dot. Further, each of these voltage pulse rows has a time width of which length is within a time Tp during which the printing paper P is moved by a distance corresponding to one dot when the printing paper P is transferred (see FIG. 1). Each of the jetting voltage pulse rows is applied to the piezoelectric actuator 21 so as to synchronize with the length of time Tp during which the printing paper P is moved by one dot, namely synchronize with a printing cycle.

Figure 8C:
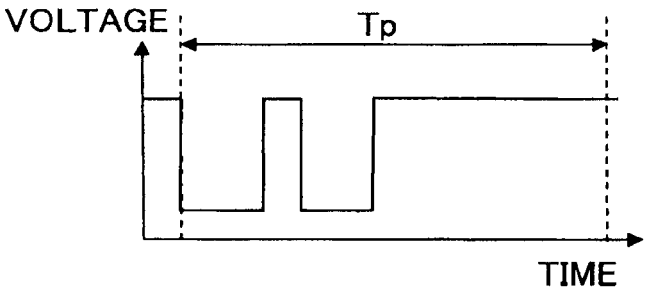
Figure 8D:
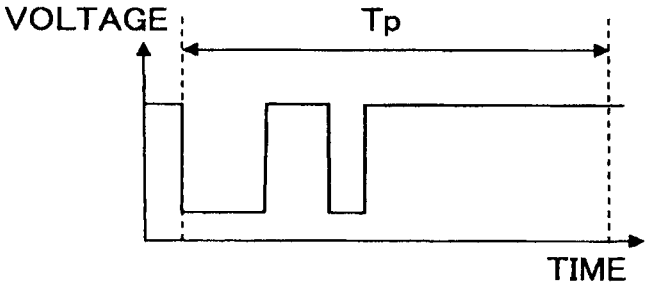

FIG. 8C shows an example of the jetting pulse for jetting an ink droplet having an ink amount smaller than that of the ink droplet jetted by the jetting pulse shown in FIG. 8B. The jetting pulse of FIG. 8C is formed of a pulse row in which the basic jetting pulse of FIG. 8A is emitted as two consecutive basic jetting pulses, and has a number of the jetting pulse is smaller than that in the jetting pulse of FIG. 8B. On the other hand, FIG. 8D shows an example of the jetting pulse for jetting an ink droplet having an ink amount smaller than that of the ink droplet jetted by the jetting pulse shown in FIG. 8C (consequently, further smaller than that of the ink droplet jetted by the basic jetting pulse shown in FIG. 8B). The jetting pulse of FIG. 8D is formed of a pulse row in which the basic jetting pulse of FIG. 8A is emitted as two consecutive basic jetting pulses, but a width of the one of the basic jetting pulses is smaller than a width of the other of the basic jetting pulses and an interval between the two basic pulses are great.

As described above, sometimes a difference or variation arises in the ink-jetting characteristics between a case in which the ink is jetted concurrently from two nozzles 28 (multiple or concurrent jetting) and in a case in which the ink is jetted singly from each of the nozzles 28 (single jetting). In this specification, the phrase "the ink is jetted singly" means that the ink is jetted from a certain one nozzle 28 at a timing which is sufficiently apart or different from a timing at which the ink is jetted from another nozzle 28, to an extent that the ink-jetting from the certain nozzle 28 is not affected by the ink-jetting from the another nozzle 28; or that the ink is jetted from nozzles belonging to a certain nozzle row 58 at a timing which is sufficiently apart or different from a timing at which the ink is jetted from nozzles belonging to another nozzle row 58, to an extent that the ink-jetting from the nozzles belonging to the certain nozzle row 58 is not affected by the ink-jetting from the nozzles belonging to the another nozzle row 58.

When there is a difference in the jetting characteristics between a case in which the ink is jetted singly from one nozzle 28 and in a case the ink is jetted from two nozzles 28, there is a fear that an image formed by the ink-jetting is non-uniform in some cases. To solve this problem, the inventor confirmed that when the ink is jetted from two different nozzles in a same printing cycle, the ink-jetting characteristics become different depending on a delay time intervened in jetting timings for the two nozzles 28.

Figure 9A:
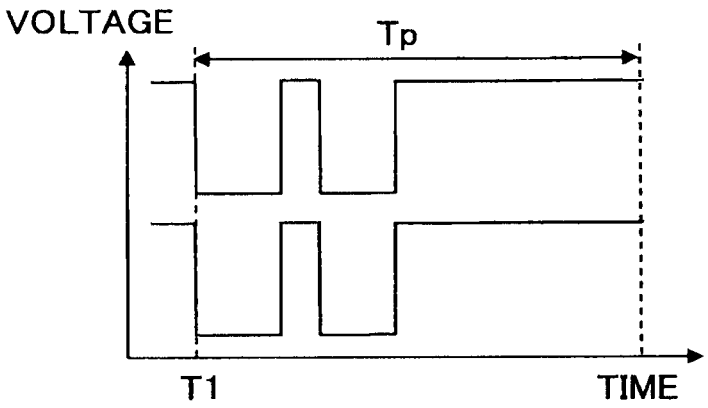
Figure 9B:
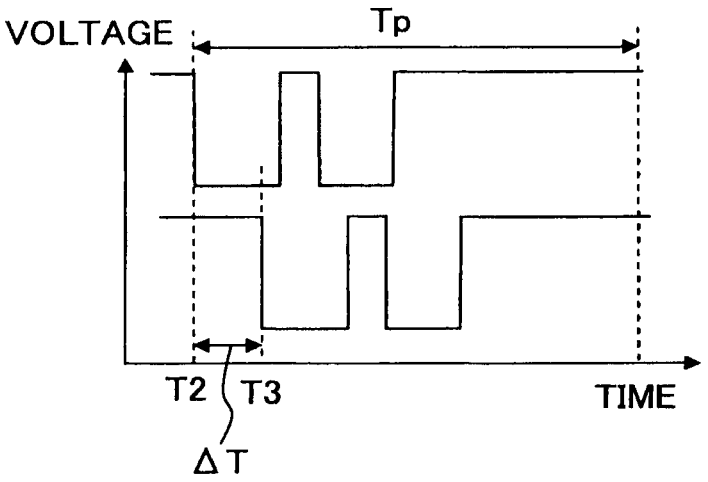

FIGS. 9A and 9B show jetting pulses in cases in each of which two nozzles 28 jet the ink in a same printing cycle. FIG. 9A shows a case that a jetting pulse row is supplied at time T1 concurrently to portions of the piezoelectric actuator 21 corresponding to two nozzles 28. On the other hand, FIG. 9B shows a case that a jetting pulse row is supplied at a time T2 to one of the portions, of the piezoelectric actuator 21, corresponding to one of the two nozzles 28, and at a time T3 to the other of the portions, of the piezoelectric actuator 21, corresponding to the other of the two nozzles 28, with a delay time ΔT being intervened (between) the time T2 and the time T3. The inventor confirmed the fact that there is a difference in the ink-jetting characteristics between the cases shown in FIGS. 9A and 9B; and that in the case of FIG. 9B, the ink-jetting characteristics is changed by changing the delay time ΔT.

Figure 10A:
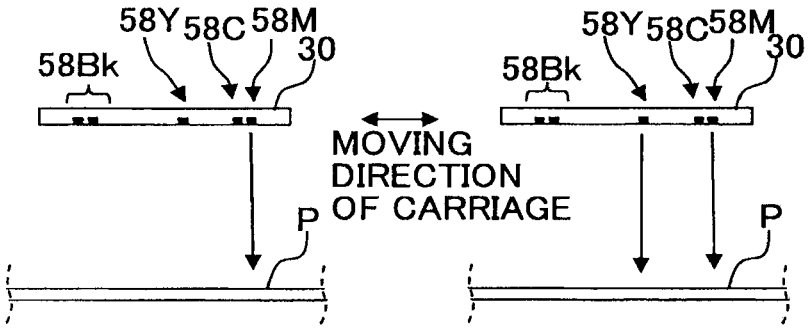
FIG. 10A is a side view showing a state that the ink is being jetted from the ink-jet head shown in FIG. 2.

The above-described fact has been confirmed by forming a following image. FIG. 10A shows a situation when the image is formed. A predetermined jetting timing is set for each of the nozzle rows 58, and the ink is jetted concurrently from a plurality of nozzles, belonging to each of the nozzle rows 58, based on the jetting timing predetermined therefor. In this embodiment, the image is formed by jetting the ink concurrently from nozzles 28 belonging to a same nozzle row 58. Further, in this embodiment, among two nozzle rows 58Bk, the black ink is jetted from only any one of the two nozzle rows 58Bk. However, the ink may be jetted concurrently from the two nozzle rows 58Bk. In such a case, the two nozzle rows 58Bk will be considered as one nozzle row in the following.

The ink-jetting for forming image is performed while moving the carriage (ink-jet head 30) in a direction at a constant speed. At this time, an ink of one color is jetted continuously from one nozzle row among the nozzle rows 58Bk, 58C, 58M and 58Y; and at a timing when the carriage reaches a predetermined position, an ink of another color is jetted from another row which is different from the one nozzle row, concurrent to the ink-jetting from the one nozzle row. For example, FIG. 10A shows a situation that the magenta ink is continuously jetted from the nozzle row 58M, and a situation that the yellow ink is jetted from the nozzle row 58Y at a predetermined position, while the magenta ink is being continuously jetted from the nozzle row 58M.

Figure 10B:
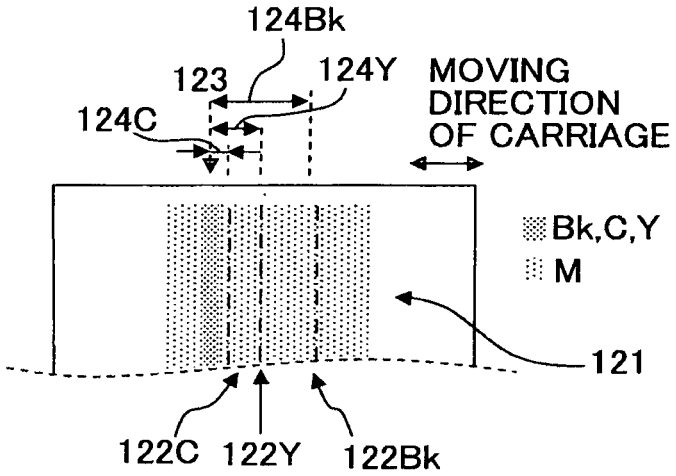
FIG. 10B shows an image formed on a printing paper by the ink jetting as shown in FIG. 10A.

By jetting the inks in such a manner as described above, an image 121 is formed on the recording paper P as shown in FIG. 10B. A substantial part of the image 121 is a solid-color image of the magenta color formed with the ink jetted continuously from the nozzle row 58M. Further, a lines, formed by the ink-jetting from the nozzle rows 58Bk, 58C and 58Y respectively, are formed in the image 121 at the predetermined position 123.

In forming such an image, when the ink is jetted from one of the nozzle rows 58Bk, 58C and 58Y, the ink-jetting is performed from the nozzle row 58M in a same printing cycle together with the ink-jetting from one of the nozzle rows 58Bk, 58C and 58Y. Consequently, there is a possibility that in some case the ink-jetting from the nozzle rows 58Bk, 58C or 58Y influences the ink-jetting characteristics (jetting speed and the like) of the ink-jetting from the nozzle row 58M. For example, when the ink is jetted from the nozzle row 58Y at the predetermined position 123, the ink from the nozzle row 58M is landed on a position indicated by a one-dot chain line 122Y. The position of the one-dot chain line 122Y is a position away from the predetermined position 123 by a distance 124Y between the nozzle rows 58M and 58Y in the ink-jet head 30. Therefore, the influence of the ink-jetting from the nozzle row 58Y to the ink-jetting from the nozzle row 58M appears in the formed image at the position of the one-dot chain line 122Y. Similarly, when the ink is jetted from the nozzle row 58Bk or 58C at the predetermined position 123, the influence of the ink-jetting from the nozzle row 58Bk or 58C to the ink-jetting from the nozzle row 58M appears in the formed image at a position indicated by a one-dot chain line 123BK or 122C. The distance between the predetermined position 123 and the one-dot chain 122Bk and the distance between the predetermined position 123 and the one-dot chain 122C are equal to the distance 124Bk between the nozzle rows 58M and 58Bk and the distance 124C between the nozzle rows 58M and 58C, respectively.

On the other hand, the ink is jetted singly from the nozzle row 58M at a position sufficiently away from the one-dot chain lines 122C, 122Y and 122Bk. Therefore, the ink-jetting from the nozzle row 58M is not affected by the ink-jetting from the nozzle row 58Bk, 58M or 58Y. With this, in the solid-color image of magenta color formed by the magenta ink jetted from the nozzle row 58M, there arises an appearance (visual) difference between a portion, of the solid-color image, in the vicinity of the one-dot chain lines 122C, 122Y and 122Bk and another portion away from these one-dot chain lines.

Further, when the inks are jetted from different nozzles in a same printing cycle, images were formed in the manner as described above, based on various delay times ΔT (by various kinds of the delay time ΔT) in the jetting timings as shown in FIG. 9B. For example, when the ink is jetted from the nozzle row 58M at the predetermined position 123 in FIG. 10B, the jetting timing for the ink jetted from the nozzle row 58Y was at the time T2, and the jetting timing for the ink jetted from the nozzle row 58M was at the time T3. Then, the formation of the image shown in FIG. 10B was performed a plurality of times while variously changing the delay time ΔT between the times T2 and T3.

Figure 11A:
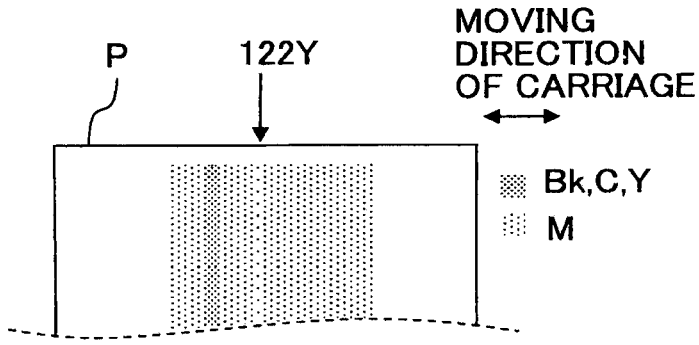
FIGS. 11A to 11C show images formed in recording papers, respectively, when the inks are jetted at different timings respectively.
Figure 11B:
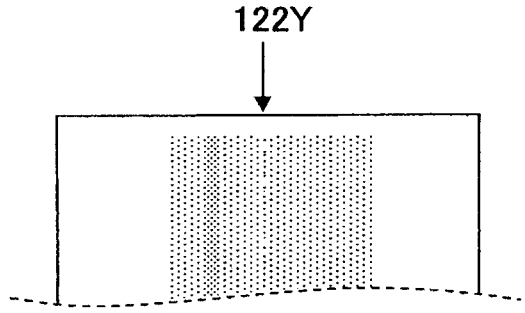
Figure 11C:
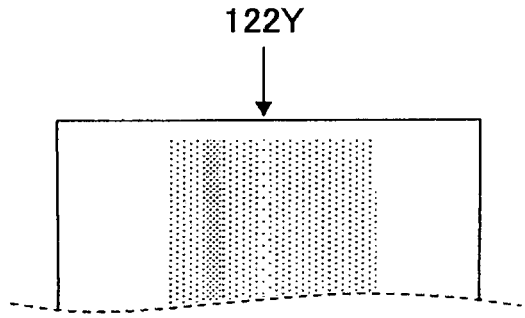

FIGS. 11A to 11C show examples of an image formed by different delay times ΔT, respectively. In each of FIGS. 11A to 11C, the influence of the ink-jetting from the nozzle row 58Y to the ink-jetting from the nozzle row 58M appears as a streak-like portion at the position 122Y. Further, FIGS. 11A to 11C show that an extent by which the ink-jetting from one of two different nozzle rows is affected by the ink-jetting from the other of the two nozzle rows differs depending on the delay time ΔT intervened in the jetting timings for the two different nozzle rows. In this way, it was confirmed that the jetting characteristics differ between a case in which the ink is jetted from a single nozzle row in one printing cycle and in a case the inks are jetted from different nozzle rows respectively in one printing cycle; and that the ink-jetting characteristics are varied by changing the delay time ΔT.

Figure 12A:
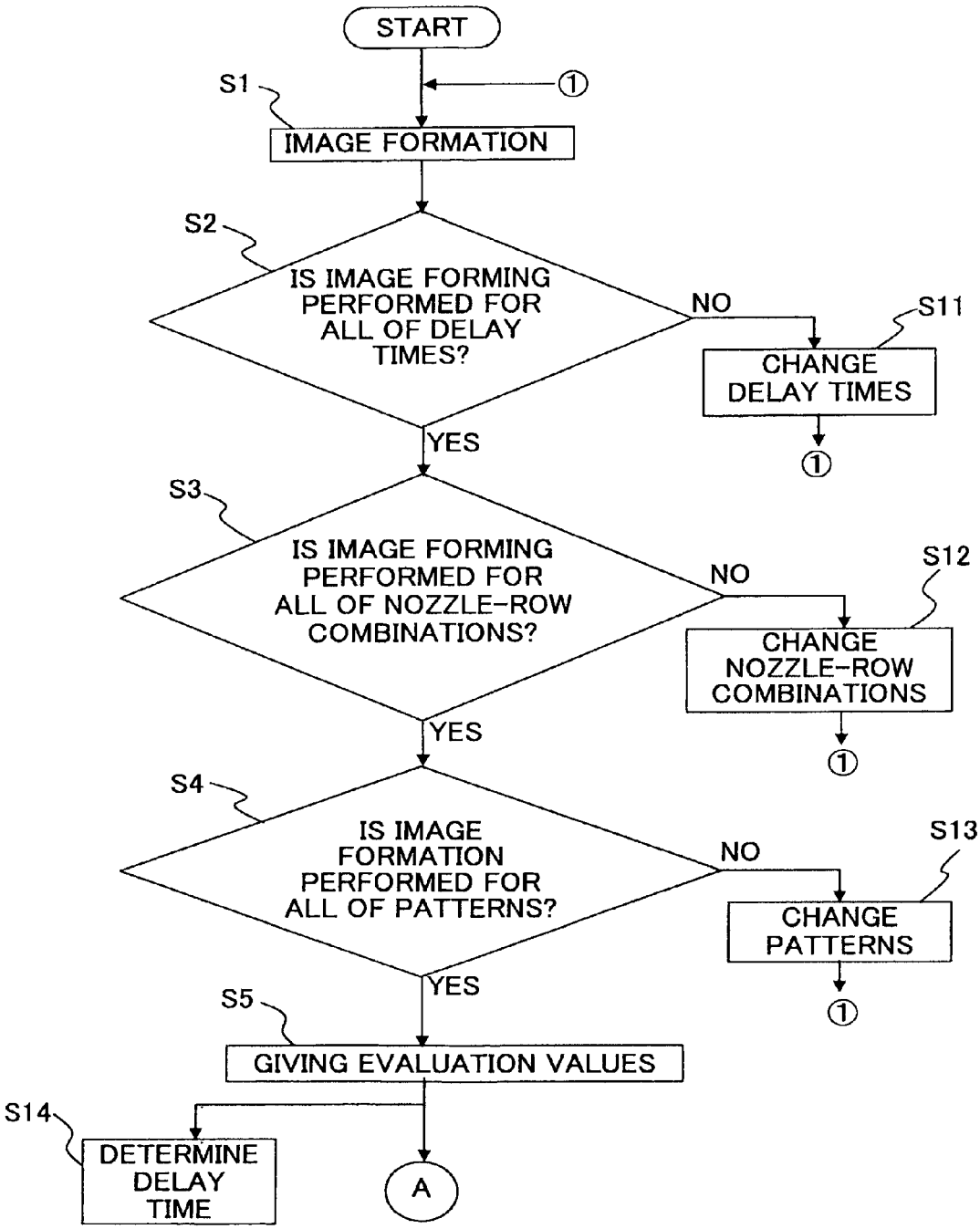
FIGS. 12A and 12B show a flow chart of a series of steps in a jetting-timing determining method as an embodiment of the present invention.
Figure 12B:
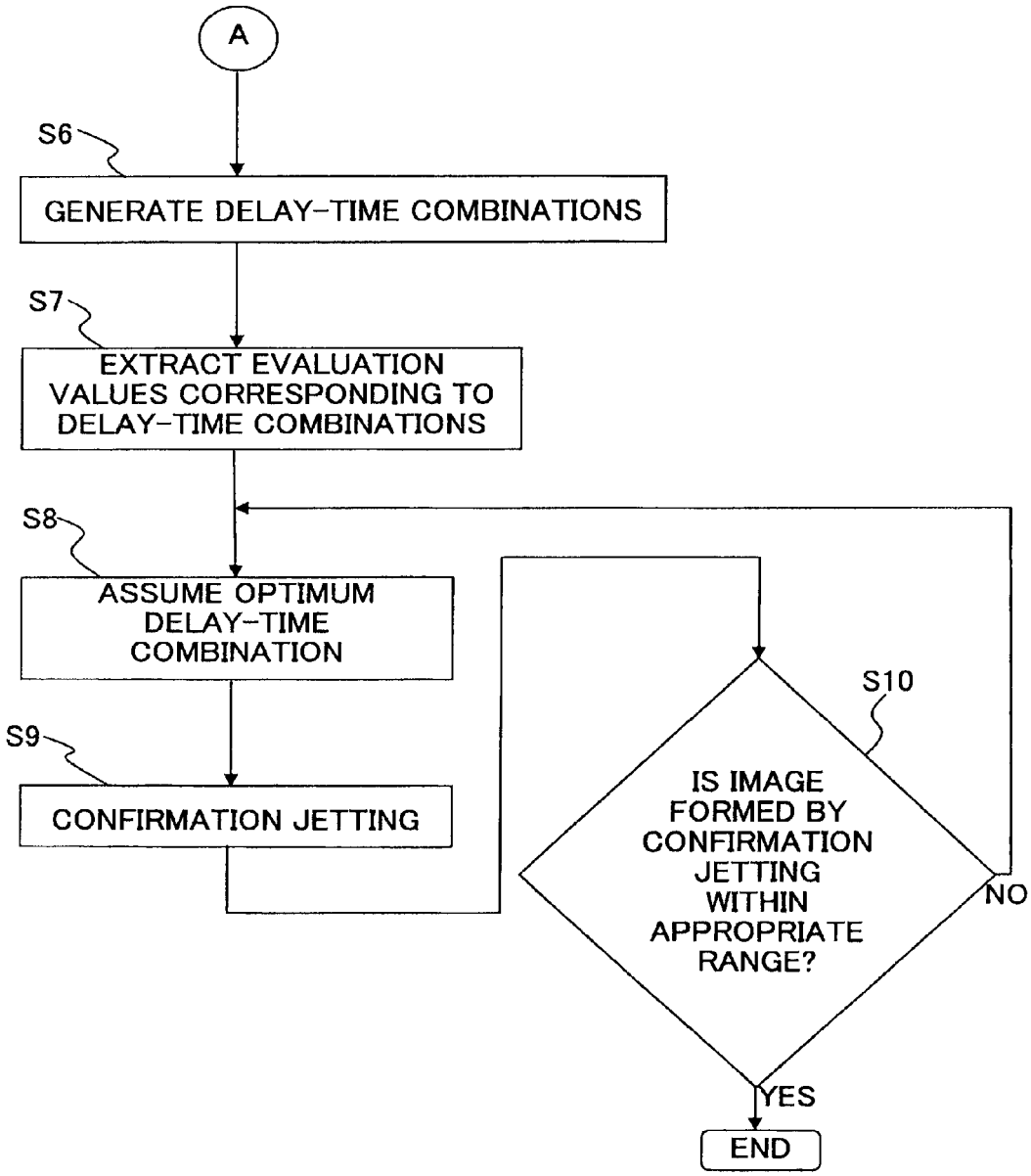

An explanation will be given about an optimum method for determining jetting timings based on the above-described facts. FIGS. 12A and 12B shows a flow chart of a series of steps in the jetting-timing determining method according to the present invention.

First, formation of an image as shown in FIG. 10A, 10B is performed based on various kinds of the delay time ΔT in the jetting timings (S1, S2 and S11). In the embodiment of the present invention, the image formation is performed for combinations of two nozzle rows, which are extracted from the nozzle rows 58Bk, 58Y, 58C and 58M, at jetting timings with various delay time ΔT being intervened therein. Namely, in FIG. 10A, 10B, while a solid-color image is being formed by the ink jetted from a certain nozzle row (first nozzle group) among the nozzle rows 58Bk, 58Y, 58C and 58M, the ink is jetted at the predetermined position 123 from another nozzle row (one of the selected nozzle groups) which is different from the certain nozzle row. When the ink is jetted from the latter (another) nozzle row, in the same printing cycle, the ink is jetted from the former (certain) nozzle row at a jetting timing which is delayed, by a predetermined delay time, from a jetting timing at which the ink is jetted from the latter nozzle row. Further, with respect to these two nozzle rows, the image formation is performed a plurality of times (S1) at each of which the delay time is changed ("NO" in S2; and S11).

When the image formation is performed for all the various kinds of the delay time ΔT ("YES" in S2), then the combination of the two nozzles is changed ("NO" in S3; and S12) to repeat the image formation in S1, S2 and in S11. At this time, each of the nozzle rows 58Bk, 58C, 58M and 58Y is used at least once for forming the solid-color image. Further, the image formation is performed for all the nozzle-row combinations by using each of the nozzle rows for forming the solid-color image while jetting the ink, at the predetermined position 123, from another nozzle row selected from the remaining nozzle rows other than the nozzle row forming the solid-color image. When the image formation is performed for all the nozzle-row combinations ("YES" in S3), step S4 is executed.

In this embodiment, a plurality of patterns are used to form the solid-color image to be formed by the one nozzle row. FIGS. 13A to 13D show such patterns respectively. In this embodiment, the ink-jet head 30 is assumed as an ink-jet head which jets the liquid droplets in various ink amounts. For example, an ink droplet jetted by the jetting pulse shown in FIG. 8B is landed on the printing paper P to form a large dot 111 shown in FIGS. 13A to 13D. On the other hand, an ink droplet jetted by the jetting pulse shown in FIG. 8D is landed on the printing paper P to form a small dot 113 shown in FIG. 13D.

Figure 13A:
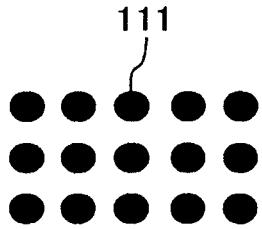
Figure 13B:
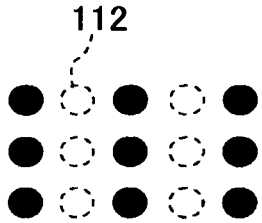
Figure 13C:
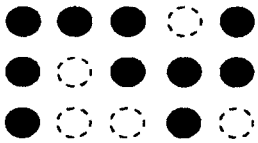
Figure 13D:
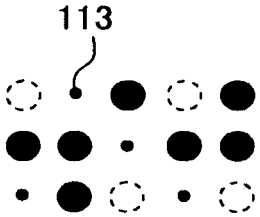

The image formation is performed, by a combination of the large and small dots as described above and a blank 112 so as to form a plurality of patterns as shown in FIGS. 13A to 13D. A pattern shown in FIG. 13A is formed only of the large dots. A pattern shown in FIG. 13B is formed by alternately arranging a row of the large dots and a row of the blanks. A pattern shown in FIG. 13C is formed of the large dots and the blanks which are randomly arranged in rows so that a ratio of the large dots to blanks is 2:1. A pattern shown in FIG. 13D is formed of the large dots, small dots and blanks which are randomly arranged in rows in a 1:1:1 ratio.

In the jetting-timing determining method of the present invention, solid-color images are formed by using such a plurality of patterns. In other words, when the image formation has been performed for one of the patterns in steps S1 to S3, S11 and S12, it is judged whether or not the image formation has been performed for all the patterns (S4). When it is judged that the image formation has been performed for only a part of the patterns ("NO" in S4), the pattern is changed (S13), and then the image formation is performed in accordance with in steps S1 to S3, S11 and S12. On the other hand, when it is judged that the image formation has been performed for all the patterns ("YES" in S4), step S5 is executed.

Next, in step S5, evaluation values are given for the images, respectively, formed in the manner as described above. In the embodiment, the evaluation is made based on a comparison between a portion, in an image, formed by the ink jetting from one nozzle row in one printing cycle and another portion, in the image, formed by the ink jetting from two nozzle rows in one printing cycle; and a comparison between different images. Then, evaluation values are given in three degrees of 0 to 2.

For example, in FIG. 11A, when the ink is jetted from the nozzle row 58M at the position 122Y, the ink is jetted also from the nozzle row 58Y in the same printing cycle. On the other hand, the ink is jetted from singly (only) from the nozzle row 58M at a position away from the position 122Y. Consequently, in FIG. 11A, there arises unevenness (disturbance) in the printing quality at the position 122Y such that the contrasting density is varied, the pattern is disturbed, and/or the like, as compared with the printing quality at other position in the image.

Further, when a comparison is made among the images shown in FIGS. 11A to 11C which are mutually different in the delay time in the discharge timings, the extent of the unevenness at the position 122Y are different among the images. Namely, the disturbance is least conspicuous in FIG. 11B, and the disturbance is most conspicuous in FIG. 11C. In other words, in the image of FIG. 11C, the printing quality at the position 122Y is least different from the printing quality at a position away from the position 122Y. Consequently, the evaluation values of 1, 2 and 0 are given to the images of FIGS. 11A, 11B and 11C, respectively. In such a manner, the evaluation values are given by visually observing the images to perform sensory evaluation for the images.

It is also allowable to simply compare the images and extract two images which are most different from each other among the images, so as to give an evaluation of "0" to one of the two images in which the disturbance is more conspicuous, and to give an evaluation of "2" to the other of the two images in which the disturbance is less conspicuous. In this case, among the images, an evaluation value for an image other than these two images is given based on the difference between this image and each of the two images. Alternatively, it is allowable to set in advance a standard to give the evaluations. For example, a comparison may be made between the image quality at the position 122Y and the image quality at position different from the position 122Y, and that the evaluation value of "2" may be given when there is little difference between the positions, the evaluation value of "1" may be given when there is a difference between the positions but within a practically allowable range or extent, and the evaluation value of "0" may be given when there is great difference between the positions and outside the practically allowable range. Note that, for example, when it is desired to determine optimum jetting timings for two nozzle rows, it is also possible to determine a delay time with which the influence of the cross talk between the nozzle rows is minimum (least conspicuous), based on the evaluation values given in S5 (S14; first determining step).

In the followings, Tables 1 to 4 show examples of the evaluation results in which the evaluation values are given as described above. Table 1 includes evaluation values in a case that, when solid-color images are made with two patterns by jetting the ink from the nozzle row 58Bk, the other nozzle rows 58Y, 58C and 58M jet the inks at various kinds of the delay time intervened in jetting timings, among the nozzle rows, respectively. In addition, Tables 2 to 4 show the results in which the nozzle row forming the solid-color image is changed to the nozzle rows 58Y, 58C and 58M, respectively.

TABLE 1

| Nozzle | | Delay time [μs] | | | | |
|---|---|---|---|---|---|---|
| row | Pattern | −2 | −1 | 0 | 1 | 2 |
| Y | (a) | 2 | 1 | 1 | 1 | 1 |
| | (b) | 2 | 2 | 2 | 2 | 2 |
| C | (a) | 2 | 1 | 1 | 2 | 1 |
| | (b) | 2 | 1 | 0 | 2 | 1 |
| M | (a) | 2 | 2 | 1 | 2 | 2 |
| | (b) | 2 | 2 | 2 | 1 | 2 |

TABLE 2

| Nozzle | | Delay time [μs] | | | | |
|---|---|---|---|---|---|---|
| row | Pattern | −2 | −1 | 0 | 1 | 2 |
| Bk | (a) | 0 | 0 | 0 | 0 | 0 |
| | (b) | 0 | 0 | 0 | 0 | 0 |
| C | (a) | 1 | 1 | 0 | 1 | 1 |
| | (b) | 2 | 2 | 1 | 1 | 2 |
| M | (a) | 2 | 2 | 0 | 2 | 0 |
| | (b) | 1 | 1 | 0 | 0 | 0 |

TABLE 3

| Nozzle | | Delay time [μs] | | | | |
|---|---|---|---|---|---|---|
| row | Pattern | −2 | −1 | 0 | 1 | 2 |
| Bk | (a) | 1 | 0 | 0 | 0 | 0 |
| | (b) | 1 | 0 | 0 | 2 | 0 |
| Y | (a) | 1 | 0 | 0 | 1 | 1 |
| | (b) | 1 | 0 | 1 | 1 | 1 |
| M | (a) | 1 | 0 | 0 | 1 | 1 |
| | (b) | 0 | 1 | 0 | 0 | 0 |

TABLE 4

| Nozzle | | Delay time [μs] | | | | |
|---|---|---|---|---|---|---|
| row | Pattern | −2 | −1 | 0 | 1 | 2 |
| Bk | (a) | 2 | 0 | 0 | 0 | 0 |
| | (b) | 2 | 0 | 0 | 1 | 0 |
| Y | (a) | 1 | 0 | 0 | 1 | 1 |
| | (b) | 1 | 0 | 0 | 2 | 1 |
| C | (a) | 0 | 0 | 0 | 0 | 0 |
| | (b) | 0 | 1 | 2 | 1 | 1 |

Next, an average value of the evaluation values given to the pattern, respectively, is calculated for each of the nozzle rows. For example, following Tables 5 to 8 each show the calculated average values for Tables 1 to 4, respectively. For example, in Table 5, a value of "1.5" for the nozzle row "Y" with the delay time of "0" is the average value for two values "1" and "2" in Table 1 given for the patterns (a) and (b) for the nozzle row "Y" with the delay time of "0".

TABLE 5

| Nozzle | Delay time [μs] | | | | |
|---|---|---|---|---|---|
| row | −2 | −1 | 0 | 1 | 2 |
| Y | 2 | 1.5 | 1.5 | 1.5 | 1.5 |
| C | 2 | 1 | 0.5 | 2 | 1 |
| M | 2 | 2 | 1.5 | 1.5 | 2 |

TABLE 6

| Nozzle | Delay time [μs] | | | | |
|---|---|---|---|---|---|
| row | −2 | −1 | 0 | 1 | 2 |
| Bk | 0 | 0 | 0 | 0 | 0 |
| C | 1.5 | 1.5 | 0.5 | 1 | 1.5 |
| M | 1.5 | 1.5 | 0 | 1 | 0 |

TABLE 7

| Nozzle | Delay time [μs] | | | | |
|---|---|---|---|---|---|
| row | −2 | −1 | 0 | 1 | 2 |
| Bk | 1 | 0 | 0 | 1 | 0 |
| Y | 1 | 0 | 0.5 | 1 | 1 |
| M | 0.5 | 0.5 | 0 | 0.5 | 0.5 |

TABLE 8

| Nozzle | Delay time [μs] | | | | |
|---|---|---|---|---|---|
| row | −2 | −1 | 0 | 1 | 2 |
| Bk | 2 | 0 | 0 | 0.5 | 0 |
| Y | 1 | 0 | 0 | 1.5 | 1 |
| C | 0 | 0.5 | 1 | 0.5 | 0.5 |

Next, a plurality of combinations of delay times (delay-time combinations) in the jetting timings is generated for all the nozzle rows 58Bk, 58C, 58M and 58Y (S6). For example, a delay-time combination A is generated in which first the cyan ink is jetted from the nozzle row 58C concurrently with the black ink is jetted from the nozzle row 58Bk, and then the magenta ink is jetted from the nozzle row 58M after a delay time of 1 μs, and then the yellow ink is jetted from the nozzle row 58Y after the delay time of 1 μs. Alternatively, a delay-time combination B is generated in which the magenta ink is jetted from the nozzle row 58M, then the yellow ink is jetted from the nozzle row 58Y after a delay time of 2.5 μs, then the cyan ink is jetted from the nozzle row 58C after the delay time of 2.5 μs, and then the ink is jetted from the black nozzle row 58Bk after the delay time of 2.5 μs.

Next, based on the evaluation values given in S5, an evaluation value is extracted corresponding to each of the combinations of delay times generated in S6 (S7). For example, the evaluation value corresponding to the combination A is extracted as follows. In the following, Table 9 shows a relationship between the combination A and the delay times. A value indicated for a row for a certain nozzle row and a column for another nozzle row indicates a delay time (lag time) in a jetting timing at which the ink is jetted from a nozzle row indicated in the row for the certain nozzle row is performed after the ink is jetted from a nozzle row indicated in the column for the another nozzle row. For example, the value for row "Bk" and column "Y" is "−2". This indicates that the jetting timing from the nozzle row 58Bk is delayed from the jetting timing from the nozzle row 58Y by −2 μs.

In the following, Table 10 indicates evaluation values corresponding to Table 9 extracted from Tables 5 to 8. In Table 10, values indicated in the fields correspond to the evaluation values, respectively, in Tables 5 to 8 as follows. In Table 10, columns correspond to cases in each of which the ink is jetted from one of the nozzles belonging to a certain nozzle row indicated in the columns, respectively, to form the solid-color image. For example, the column "Bk" corresponds to a case from Table 9 in which the black ink is jetted from the nozzle row 58Bk to form the solid-color image. Accordingly, the column "Bk" corresponds to Table 5. Further, Table 10 corresponds to Table 9. For example, in Table 10, the value for row "M" and column "Bk" corresponds to a case from Table 9 in which the jetting timing in the nozzle row 58M is delayed from the jetting timing in the nozzle row 58Bk by 1 μs. Accordingly, the row "M" and the column "Bk" in Table 10 correspond to the row "M" and the delay time "−1" in Table 5. Therefore, the value for row "M" and column "Bk" in Table 10 is "2" from Table 5.

TABLE 9

| | Bk | Y | M | C |
|---|---|---|---|---|
| Bk | — | −2 | −1 | 0 |
| Y | 2 | — | 1 | 2 |
| M | 1 | −1 | — | 1 |
| C | 0 | −2 | −1 | — |

TABLE 10

| | Bk | Y | M | C |
|---|---|---|---|---|
| Bk | — | 0 | 0.5 | 0 |
| Y | 2 | — | 0 | 1 |
| M | 2 | 1 | — | 0.5 |
| C | 0.5 | 1.5 | 0.5 | — |

Evaluation values are extracted also for the combination B in a similar manner. In the following, Table 11 shows relationships, between the delay times, corresponding to the combination B; and Table 12 shows extracted evaluation values corresponding to Table 11. Note that the results indicated in Tables 11 and 12 are extracted based on results which are not included in Tables 5 to 8. In other words, the results in Tables 11 and 12 are extracted from a sample group including a larger number of samples than that in the sample group for the evaluation values indicated in Tables 5 to 8. The method for extraction, however, is same as that for Tables 9 and 10.

As indicated in Table 11, in a case that the delay time is 2.5 μs which is not included in the delay times indicated in Table 5 and the like, it is allowable to estimate the evaluation value for such a delay time. In this case, an intermediate value is derived corresponding to an intermediate value between delay times. For example, when the delay time is 2.5 μs, an intermediate value is used between the evaluation value for a 2 μs-delay time and the evaluation value for a 3 μs-delay time. By using the intermediate value between the evaluation values, it is possible to evaluate the combination of delay times for a great number of cases from a small number of samples. Namely, an advantage is obtained such that the number of image formation is small.

TABLE 11

| | Bk | Y | M | C |
|---|---|---|---|---|
| Bk | — | 4.5 | 7 | 2 |
| Y | −4.5 | — | 2.5 | −2.5 |
| M | −7 | −2.5 | — | −5 |
| C | −2 | 2.5 | 5 | — |

TABLE 12

| | Bk | Y | M | C |
|---|---|---|---|---|
| Bk | — | 2 | 2 | 1.2 |
| Y | 1.75 | — | 1.3 | 1.2 |
| M | 1.75 | 0.25 | — | 1.2 |
| C | 1 | 1.75 | 1.5 | — |

Next, based on the extracted evaluation values extracted in S7, an optimum combination of the delay times (optimum delay-time combination) is estimated (S8). In S7, a plurality of evaluation values are extracted corresponding to a plurality of combinations of delay times (delay-time combinations). These evaluation values are compared to thereby extract a combination of delay times corresponding to the optimum image. In this embodiment, a combination of delay times, which corresponds to an extremely low evaluation value, is neglected in the estimation process. For example, in Table 10, there are seven cases in each of which the evaluation value is less than "1". On the other hand, in Table 12, there is only one case in which the evaluation value is less than "1". In this manner, the comparison of Table 10 and Table 12 shows that the evaluation values in the combination A includes low evaluation values more than those in the combination B. Consequently, it is estimated that a combination of delay times corresponding to the optimum image is the combination B, rather than the combination A.

Alternatively, it is allowable to estimate the combination of delay times, corresponding to the optimum image, based on an average value of the evaluation values. For example, an average value of the evaluation values indicated in Table 10 is "0.79". On the other hand, an average value of the evaluation values indicated in Table 12 is "1.4". Consequently, it is estimated that the combination B, corresponding to Table 12 with a higher average value, corresponds to the optimum image. Still alternatively, it is allowable that a combination corresponding to the optimum image is estimated based on any statistic obtained from the evaluation values.

Further, as shown in the combination B, the quality of an image formed by the ink jetting from the different nozzle rows is often satisfactory in a case that the jetting timing from the nozzle row 58Bk is before or after (non-concurrent with) the jetting timing from any other nozzle row different from the nozzle row 58Bk. The reason for this is considered that, by setting the jetting timing from the nozzle row 58Bk to be before or after the jetting timing from any one of the other nozzle rows, the ink jetting from the color nozzle rows 58C, 58M and 58Y is less likely to affected by the ink jetting from the black nozzle row 58Bk. Accordingly, it is desirable that a combination of delay times is extracted or estimated such that the jetting timing from the nozzle row 58Bk is set before or after the jetting timing from any one of the remaining nozzle rows.

Next, based on the optimum combination of delay times estimated in S8, a confirmation-jetting is performed (S9). It is allowable, for example, to form an image based on a data regarding a predetermined sample image. In this case, upon forming the sample image, the inks are jetted from the four nozzle rows in a same printing cycle, at the jetting timings corresponding to those of the optimum delay-time combination.

Figure 14A:
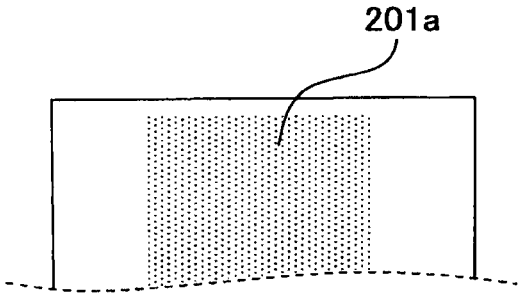
FIGS. 14A and 14B show images, respectively, formed in recording papers in a confirmation-jetting step shown in FIGS. 12A and 12B.
Figure 14B:
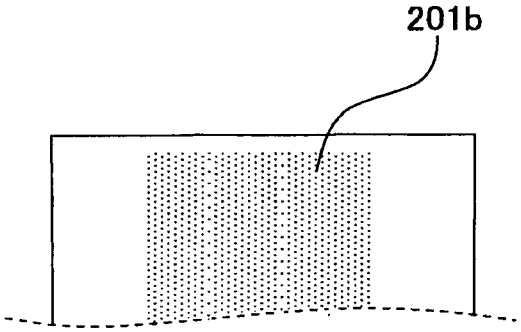

Next, based on the quality of the image formed in S9, a judgment is made whether or not the combination of delay times estimated in S8 is appropriate (S10). For example, when an image as shown in FIG. 14A is formed and it is judged that reproducibility of the image is satisfactory, it is judged that the combination of delay times estimated in S8 is appropriate ("YES" in S10). On the other hand, as shown in FIG. 14B, when there is a disturbance (unevenness) in image quality compared to the sample image, it is judged that the combination of delay times estimated in S8 is not appropriate; and the estimation of the combination of delay times (S8) is performed again ("NO" in S10).

According to the jetting-timing determining method, following effects can be obtained. First, since a combination of delay times corresponding to the optimum image is estimated, it is possible to realize a satisfactory reproducibility of image by an ink-jet head in which discharge timings are adopted to correspond to the combination of delay time as described above.

In addition, since the image formation is performed with respect to a combination of two nozzle rows extracted from the nozzle rows including the nozzle row 58Bk and the like, a number of image formation performed is smaller than in a case in which the image formation is performed with respect to a combination of not less than three nozzle rows. Further, based on the results of such image formation, an optimum combination of delay times is estimated corresponding to all the combination of nozzle rows. Accordingly, the optimum jetting timings can be determined without performing the image formation many times.

Furthermore, since the jetting timing is estimated for each of the nozzles by the ink jetting from each of the nozzle rows, the jetting timing can be determined with a method which is simpler than in a case, for example, in which the jetting timing is determined for each of the nozzles by jetting the ink from each of the nozzles.

Moreover, since the optimum combination of delay times is estimated based on the average value of the evaluation values for image formation with respect to a plurality of patterns, suitable combinations of delay times can be estimated for various images, respectively. Note that it is also allowable to determine optimum jetting timings for each of the patterns based on the evaluation values for each of the patterns. Accordingly, it is possible to select appropriate jetting timings depending on the usage of the ink-jet printer. Alternatively, it is allowable to determine the jetting timings based on an image formed by using a pattern for which the jetting amount of the ink is least among the patterns. With this, since the jetting timings are determined based on a sensitive pattern, the appropriate timings can be determined more assuredly.

Furthermore, since the confirmation-jetting is performed after the optimum combination of delay times has been estimated, it is possible to determine the appropriate jetting timings assuredly.

In the foregoing, the preferred embodiment of the present invention has been explained. The present invention, however, is not limited to the above embodiment and can be changed in various ways within the range described in the claims.

Figure 15A:
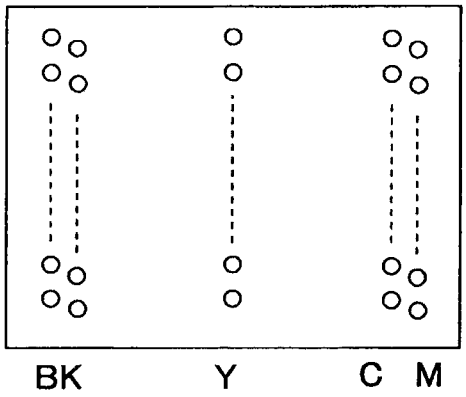
FIGS. 15A to 15D show first to fourth examples of nozzle arrangement.
Figure 15B:
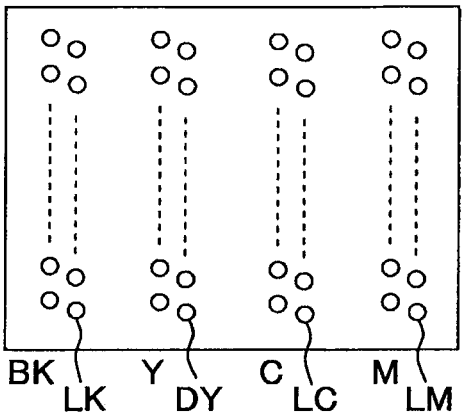
Figure 15C:
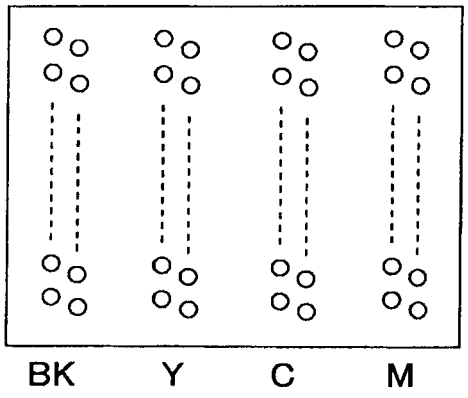
Figure 15D:
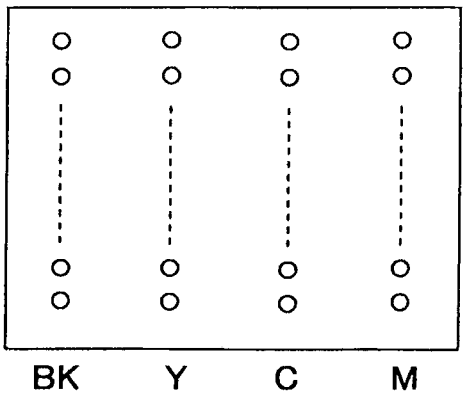

The arrangement of the nozzles is not limited to that shown in FIG. 5A. FIGS. 15A to 15D shows examples 1 to 4, respectively, of the nozzle arrangement. As shown in FIG. 15A, it is allowable to arrange the nozzles such that two nozzle rows jet a black ink (Bk); that three nozzle rows jet an yellow ink (Y), a cyan ink (C) and a magenta ink (M) respectively; and that the nozzle row for jetting the Y ink is arranged away from the nozzles rows each jetting the ink other than the Y ink. Alternatively, as shown in FIG. 15B, it is allowable to form, in addition to the nozzle rows jetting the four color inks, nozzle rows jetting a light black ink (LK), a dark yellow ink (DY), a light cyan ink (LC) and a light magenta ink (LM), respectively. Still alternatively, as shown in FIG. 15C, it is allowable that each of the Bk, Y, C and M inks is jetted from two nozzle rows. Further alternatively, as shown in FIG. 15D, it is allowable that each of the inks is jetted from one of the nozzle rows. In any of these cases, the order in which the nozzle rows are arranged per the color of the inks and the number of nozzle row for each of the color inks may be arbitrary. Further, the positional relationship among the nozzle rows in the row-arrangement direction may be arbitrary. For example, as shown in FIG. 15C, it is allowable that two nozzle rows which are mutually adjacent are shifted from each other in the row direction; and as shown in FIG. 15D, it is allowable that the adjacent rows are aligned in the row-arrangement direction.

In such a manner, optimum jetting timings can be determined for various nozzle arrangements. For example, in the nozzle arrangement as shown in FIG. 15C, the ink droplets may be jetted at jetting timings as shown in Table 13. The jetting timings shown in Table 13 indicate delay times by each of which a jetting timing for one of the color inks is delayed with respect to a predetermined timing. Table 13 shows cases for jetting large, intermediate and small ink-droplets in a normal printing mode. It is possible, however, to determine optimum jetting timings accordingly with respect to difference in printing modes such as fine printing mode, photo-printing mode and the like; difference in temperature among the inks in the head; number of inks for performing color printing; or the like. Note that when the four color inks of Bk, Y, C and M are jetted as shown in Table 13, it is desired that the Bk ink is jetted first or last, and among the three color inks of Y, C and M, the Y ink is jetted last.

TABLE 13

| | Large ink-droplet | Intermediate ink-droplet | Small ink-droplet |
|---|---|---|---|
| Bk | 1 | 6 | 10 |
| Y | 5 | 6 | 8 |
| C | 3 | 5 | 6 |
| M | 3 | 4 | 6 |

Figure 16A:
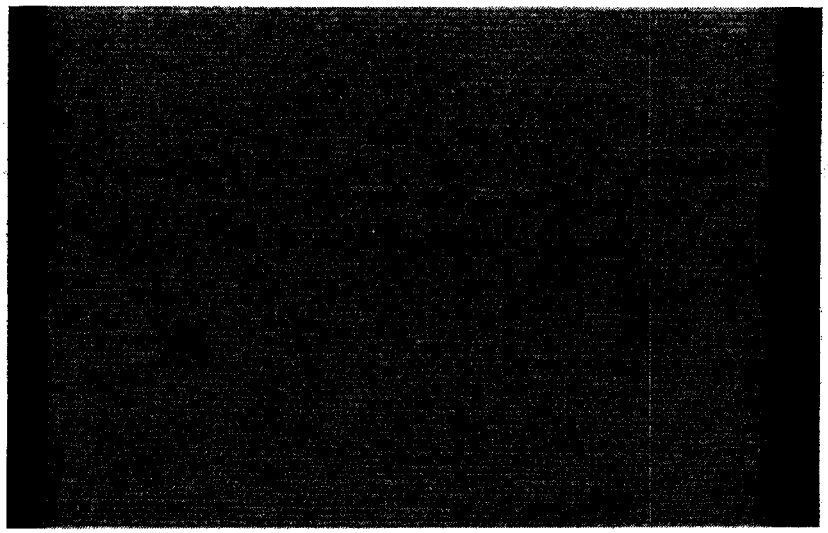
FIG. 16A shows an image obtained by jetting a plurality of color inks concurrently.
Figure 16B:
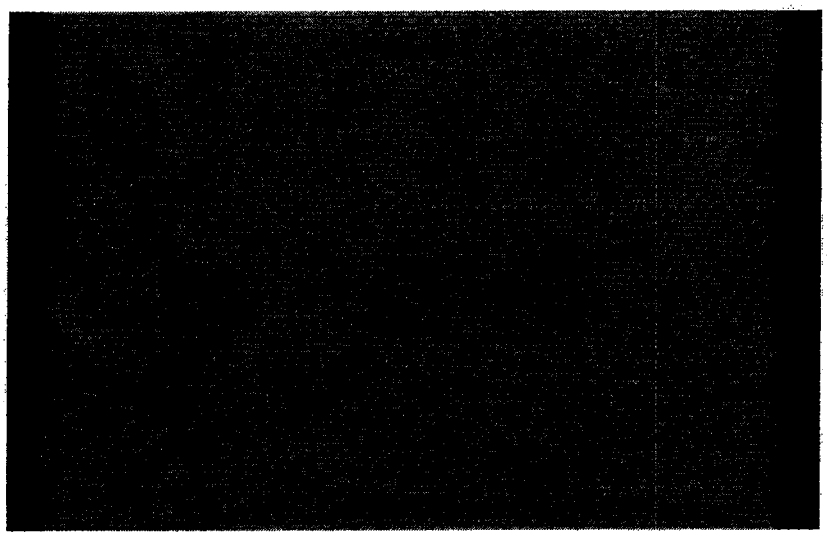
FIG. 16B shows an image obtained by jetting the color inks at optimum jetting timings, respectively, determined by the method of the present invention.

FIGS. 16A and 16B shows an imaged obtained by jetting a plurality of color inks concurrently (FIG. 16A) and an image obtained by jetting the inks at optimum timings determined by the above-described method (FIG. 16B). Upon comparing the images of FIGS. 16A, 16B, it is appreciated that the image (FIG. 16B), obtained by jetting the inks at the optimum jetting timings determined by the method as described above, is a satisfactory image having less disturbance than the other image of FIG. 16A.

Further, in the above-described embodiment, the jetting timings regarding four nozzle rows are determined by performing image formation with respect to two nozzle rows.

The present invention, however, is also applicable to a case in which the jetting timings are determined for three nozzle rows by performing image formation with respect to two nozzle rows. In this case, in S6 in FIG. 12B, combinations of delay times may be generated with respect to the jetting timings from three nozzle rows. Then, by determining both the optimum jetting timings for the three nozzle rows and the optimum jetting timings for the four nozzle rows, optimum jetting timings are consequently determined in the embodiment for all the different nozzle rows upon jetting the ink from the different nozzle rows in a same printing cycle.

Alternatively, it is allowable to set combinations of delay times in advance for three nozzle rows, and to perform the image formation corresponding to S1 in FIG. 12A by jetting the ink from the three nozzle rows based on the delay times set in advance. In this case, appropriate jetting timings can be set more assuredly for the three nozzle rows. Still alternatively, it is allowable to generate, for four nozzle rows, combinations of delay times corresponding to S6 in FIG. 12B, based on such combinations of delay times for the three nozzle rows.

In the embodiment, it is assumed to determine the jetting timing for each of the nozzle rows. It is allowable, however, to determine jetting timings for nozzle groups respectively, the nozzle groups being different from the nozzle rows. For example, the jetting timings may be determined for nozzle groups, respectively, each of the nozzle groups being formed of a half nozzles in one of the nozzle rows. Alternatively, the present application may be applied to an ink-jet head in which the nozzle rows are not formed. In this case, the jetting timings may be determined for the nozzles, respectively; or may be determined for nozzle groups respectively, each of the nozzle groups being formed of two nozzles. In each of the cases, the delay time in the jetting timings is treated corresponding to each of the nozzle groups considered as a unit.

Further, in the embodiment, the image quality is judged by performing sensory evaluation by the visual observation of the formed images. However, the image quality may be judged by, for example, measuring the uniformity of the formed image, or the like. For example, it is allowable to measure the color uniformity of the image by using colorimeter, densitometor or the like, and to judge the image quality based on the measurement result.

Furthermore, in the embodiment, the image formation is performed for all the combinations regarding two nozzle rows extracted from four nozzle rows. Namely, in each of the nozzle rows formed in the ink-jet head 30, the ink is discharged at least once upon forming the image. Moreover, each of the nozzle rows is used at least once for the ink jetting to form a solid-color image. It is allowable, however, to perform the image formation only for a part of the two nozzle rows extracted from the four nozzle rows.

In the ink-jet head of the embodiment as described above, when printing is performed in a high-definition mode (high-image quality mode), only three inks of yellow, cyan and magenta colors are used; and when printing is performed in a high-speed mode, the black ink is used in addition to the three color inks. In such a case, the jetting timings may be determined with the above-described method for each of the high-definition mode using only the three color inks and the high-speed mode using the four color inks including the black ink. Alternatively, for example, it is allowable to determine jetting timings by focusing on a predetermined combination of colors, such as yellow and black inks, such that the cross talk is particularly suppressed for the combination of such colors. In the embodiment, upon determining the jetting timings, it is possible to determined the variation in jetting speeds of the ink droplets based on the sensory evaluation for the formed images, for example, by weighted variation values obtained from calculated variation values, such that the cross talk is particularly suppressed for a predetermined combination of color inks.

A liquid-droplet jetting head, to which the liquid-droplet jetting method or the jetting timing determining method of the present invention is applicable, is not limited to an ink-jet head which jets an ink, and may be a liquid-droplet jetting head which jets a liquid other than ink such as a reagent, a biomedical solution, a wiring material solution, an electronic material solution, a cooling medium (refrigerant), a liquid fuel, or the like. In each of these cases, when an image formed by jetting one of the liquids onto a medium cannot be observed visually, it is possible to evaluate the image by a method, for example, of measuring the concentration of the liquid.

What is claimed is:

1. An ink-jet printer which jets, onto a medium, liquid droplets of a plurality of color inks including black, cyan, yellow and magenta inks at a predetermined printing cycle, the printer comprising:

a head which comprises:

a plurality of nozzles formed corresponding to the plurality of color inks, respectively;

a plurality of pressure chambers corresponding to the nozzles, respectively; and a channel which communicates the pressure chambers and the nozzles, respectively;

a carriage which carries the head thereon and moves relative to the medium; and a control unit which controls the head so that during the predetermined printing cycle, the plurality of color inks are jetted in an order in which the black ink is jetted first or last among the color inks and the yellow ink is jetted after the cyan and magenta inks;

wherein the control unit controls the head to jet the liquid droplets of the color inks at the predetermined printing cycle based on jetting timings, the control unit being configured to perform:

a forming step for forming first images by jetting a first liquid droplet from a first nozzle corresponding to a first color ink a plurality of times at a plurality of first timings and jetting a corresponding second liquid droplet from a second nozzle corresponding to a second color ink a plurality of times at a plurality of second timings, while delaying the first and second timings with respect to each other by predetermined delay times so that the first images are formed to correspond to the delay times respectively;

an evaluation step for performing evaluation of the first images; and a first extraction step for extracting, based on a result of the evaluation step, an optimum delay time, among the delay times, corresponding to an optimum first image among the first images;

wherein the delay times include positive and negative values, as well as zero.

2. The ink-jet printer according to claim 1;

wherein the nozzles form a plurality of nozzle groups each of which includes multiple nozzles, each of the nozzles belonging to one of the nozzle groups;

wherein the plurality of nozzle groups include a first nozzle group and a second nozzle group which is different from the first nozzle group, the first nozzle group including the first nozzle, and the second nozzle group including the second nozzle;

wherein the first nozzle group and the second nozzle group are selected as a grouping of nozzle groups;

wherein the forming step includes:

a jetting step for forming a plurality of first images by jetting a plurality of first liquid droplets concurrently from the nozzles of the first nozzle group of the selected grouping the plurality of times at the respective plurality of first timings, and jetting a corresponding plurality of second liquid droplets concurrently from the nozzles of the second nozzle group of the selected grouping the plurality of times at the respective plurality of second timings, so that each first image is formed to correspond to a respective one of the delay times; and wherein, in the first extracting step, the optimum delay time, among the delay times, is extracted which corresponds to an optimum first image among the plurality of first images.

3. The ink-jet printer according to claim 2;

wherein the head has a nozzle surface in which the plurality of nozzles is formed;

wherein a plurality of nozzle rows aligned in mutually parallel lines is formed in the nozzle surface; and wherein each of the nozzle rows is formed of nozzles, among the plurality of nozzles, each belonging to one of the nozzle groups.

4. The ink-jet printer according to claim 3;

wherein, in the ink-jetting step, the color inks are jetted from the first and second nozzle groups respectively, such that nozzles among the plurality of nozzles which belong to a first nozzle row among the plurality of nozzle rows jet a first color ink among the color inks, and that nozzles which belong to a second nozzle row different from the first nozzle row jet a second color ink different from the first color ink.

5. The ink-jet printer according to claim 4;

wherein in the first extracting step, the optimum delay time is extracted such that a jetting timing in nozzles which belong to a third nozzle row from which the black ink is jetted, is non-concurrent with a jetting timing in nozzles which belongs to other nozzle rows from which color inks other than the black ink are jetted respectively.

6. The ink-jet printer according to claim 3;

wherein the nozzle rows are formed as four nozzle rows in the ink-jet head.

7. The ink-jet printer according to claim 2;

wherein an ink-jetting performed by the head includes a plurality of modes which are mutually different in an amount of the ink jetted from the nozzles; and wherein, in the first extracting step, the optimum delay time is extracted for each of the modes.

8. The ink-jet printer according to claim 2;

wherein an ink-jetting performed by the ink-jet head includes a plurality of modes which are mutually different in an amount of the ink jetted from the nozzles; and wherein, in the jetting step, the ink is jetted from each of the nozzle groups in a mode in which the ink is jetted in a least amount among the modes.

* * * * *